US011532875B2

(12) United States Patent
Chiang et al.

(10) Patent No.: US 11,532,875 B2
(45) Date of Patent: Dec. 20, 2022

(54) ANTENNA MODULE

(71) Applicant: MEDIATEK Inc., Hsin-Chu (TW)

(72) Inventors: Chung-Hsin Chiang, Hsinchu (TW); Li-Yu Chen, Hsinchu (TW); Shih-Huang Yeh, Hsinchu (TW)

(73) Assignee: MEDIATEK INC., Hsin-Chu (TW)

( * ) Notice: Subject to any disclaimer, the term of this patent is extended or adjusted under 35 U.S.C. 154(b) by 0 days.

(21) Appl. No.: 17/489,900

(22) Filed: Sep. 30, 2021

(65) Prior Publication Data

US 2022/0131262 A1 Apr. 28, 2022

Related U.S. Application Data

(60) Provisional application No. 63/094,921, filed on Oct. 22, 2020.

(51) Int. Cl.
*H01Q 1/22* (2006.01)
*H01Q 1/42* (2006.01)

(52) U.S. Cl.
CPC ..... *H01Q 1/422* (2013.01); *H01Q 1/2283* (2013.01)

(58) Field of Classification Search
CPC ..... H01Q 1/422; H01Q 1/223; H01Q 1/424
USPC ..... 343/702
See application file for complete search history.

(56) References Cited

U.S. PATENT DOCUMENTS

| | | | | |
|---|---|---|---|---|
| 9,935,065 | B1 | 4/2018 | Baheti et al. | |
| 2018/0342470 | A1* | 11/2018 | Liao | H01L 23/552 |
| 2019/0051989 | A1 | 2/2019 | Kim et al. | |
| 2020/0006846 | A1 | 1/2020 | Jeong | |
| 2021/0234080 | A1* | 7/2021 | Li | H01L 33/46 |

* cited by examiner

*Primary Examiner* — Peguy Jean Pierre
(74) *Attorney, Agent, or Firm* — McClure, Qualey & Rodack, LLP

(57) ABSTRACT

An antenna module includes a first dielectric layer, an antenna layer, a grounding layer and a conductive layer. The first dielectric layer has a first dielectric surface and a second dielectric surface opposite to the first dielectric surface and a first dielectric lateral surface extending between the first dielectric surface and the second dielectric surface. The antenna layer is formed on the first dielectric surface. The grounding layer is formed below the second dielectric surface. The conductive layer is formed on the first dielectric lateral surface of first dielectric layer, wherein the conductive layer electrically connects to the grounding layer and extends from the grounding layer toward the antenna layer but not contacts the first dielectric surface.

21 Claims, 44 Drawing Sheets

ANTENNA MODULE

This application claims the benefit of U.S. Provisional application Ser. No. 63/094,921, filed Oct. 22, 2020, the disclosure of which is incorporated by reference herein in its entirety.

FIELD OF THE INVENTION

The invention relates to an antenna module, and more particularly to an antenna module including a lateral conductive layer.

BACKGROUND OF THE INVENTION

Conventional antenna module includes an antenna and a chip. The chip could transmit signal to the antenna and receives signal form the antenna. However, the chip is easy to be interfered by electromagnetic wave. Thus, how to shield electromagnetic waves from interfering with the chip becomes a prominent task for the industries.

SUMMARY OF THE INVENTION

In an embodiment of the invention, an antenna module is provided. The antenna module includes a first dielectric layer, a first antenna layer, a grounding layer and a conductive layer. The first dielectric layer has a first dielectric surface and a second dielectric surface opposite to the first dielectric surface and a first dielectric lateral surface extending between the first dielectric surface and the second dielectric surface. The first antenna layer is formed on the first dielectric surface. The grounding layer is formed below the second dielectric surface. The conductive layer is formed on the first dielectric lateral surface of first dielectric layer, wherein the conductive layer electrically connects to the grounding layer and extends from the grounding layer toward the first antenna layer but not contacts the first dielectric surface.

In another embodiment of the invention, a manufacturing method of an antenna module is provided. The manufacturing method includes the following steps: providing a structure comprising a first dielectric layer, a first antenna layer and a grounding layer, wherein the first dielectric layer has a first dielectric surface and a second dielectric surface opposite to the first dielectric surface and a first dielectric lateral surface extending between the first dielectric surface and the second dielectric surface, the first antenna layer is formed on the first dielectric surface, and the rounding layer is formed below the second dielectric surface; disposing the structure on an adhesive layer and in a penetrating portion of a metal frame; and forming a conductive layer to cover portions of the structure which are not covered by the adhesive layer and the metal frame, wherein the conductive layer is formed on the first dielectric lateral surface of first dielectric layer, wherein the conductive layer electrically connects to the grounding layer and extends from the grounding layer toward the first antenna layer but not contacts the first dielectric surface.

In another embodiment of the invention, a manufacturing method of an antenna module is provided. The manufacturing method includes the following steps: providing a structure comprising a first dielectric layer, a first antenna layer and a grounding layer, wherein the first dielectric layer has a first dielectric surface and a second dielectric surface opposite to the first dielectric surface and a first dielectric lateral surface extending between the first dielectric surface and the second dielectric surface, the first antenna layer is formed on the first dielectric surface, and the rounding layer is formed below the second dielectric surface; disposing an adhesive layer to cover the first dielectric layer of the structure; forming a plurality of first singulation passages to pass through the adhesive layer and a portion of the first dielectric layer, wherein the first dielectric layer forms a first lateral surface; forming a conductive layer to cover the adhesive layer and the first lateral surface; removing the adhesive layer to expose the first dielectric layer; and forming a plurality of second singulation passages to pass through another portion of the first dielectric layer, wherein the first dielectric layer forms a second lateral surface, and the first lateral surface and the second lateral surface are not non-coplanar.

Numerous objects, features and advantages of the invention will be readily apparent upon a reading of the following detailed description of embodiments of the invention when taken in conjunction with the accompanying drawings. However, the drawings employed herein are for the purpose of descriptions and should not be regarded as limiting.

BRIEF DESCRIPTION OF THE DRAWINGS

The above objects and advantages of the invention will become more readily apparent to those ordinarily skilled in the art after reviewing the following detailed description and accompanying drawings, in which.

DETAILED DESCRIPTION OF PREFERRED EMBODIMENTS

Figure 1A:
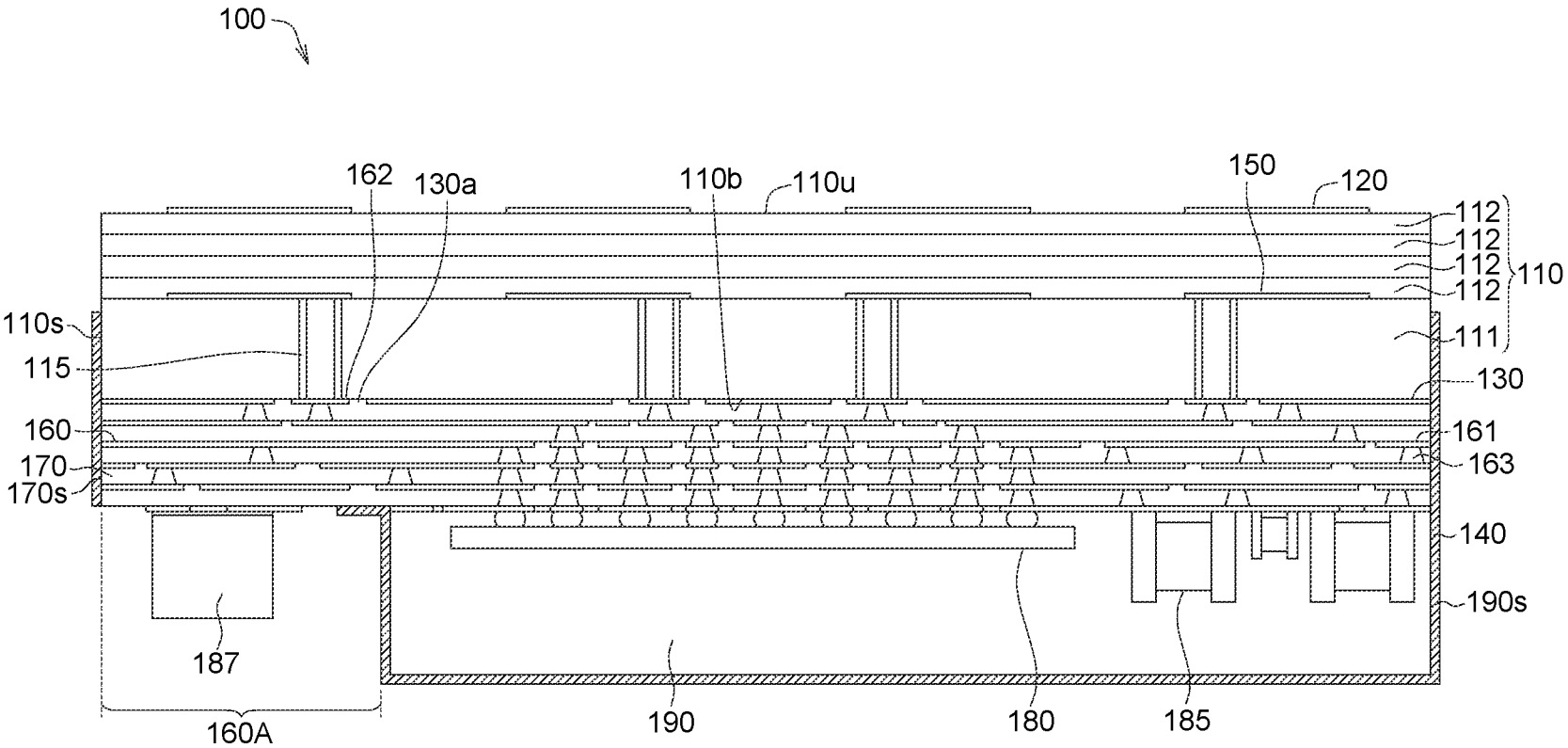
FIG. 1A illustrates a diagram view of an antenna module according to an embodiment of the invention.
Figure 1B:
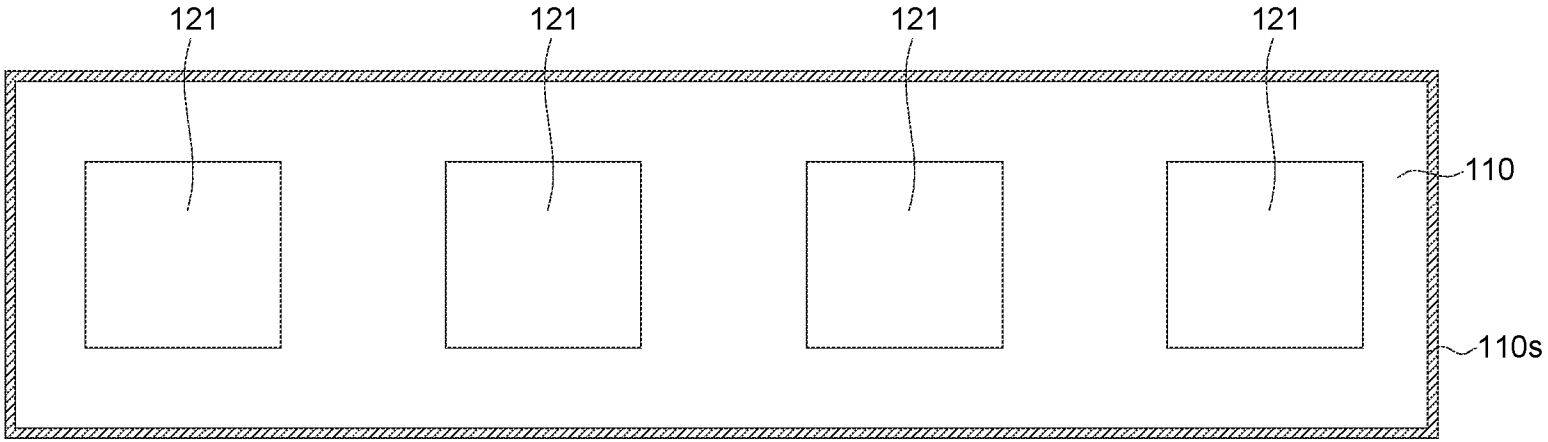
FIG. 1B illustrates a top view of the antenna module of FIG. 1A.
Figure 1C:
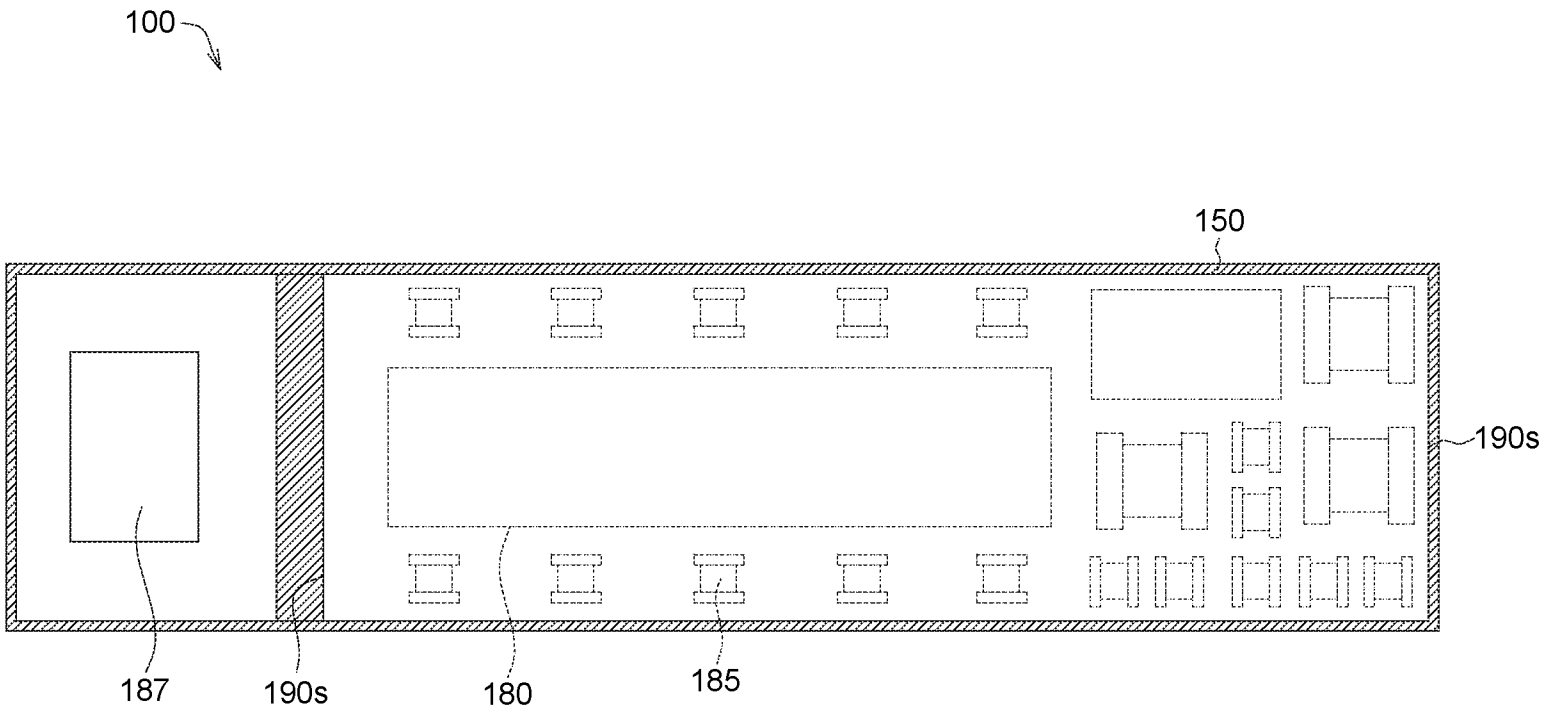
FIG. 1C illustrates a bottom view of the antenna module of FIG. 1A.

Referring to FIGS. 1A to 1C, FIG. 1A illustrates a diagram view of an antenna module 100 according to an embodiment of the invention, FIG. 1B illustrates a top view of the antenna module 100 of FIG. 1A, and FIG. 1C illustrates a bottom view of the antenna module 100 of FIG. 1A.

The antenna module 100 includes a first dielectric layer 110, at least one conductive via 115, a first antenna layer 120, a grounding layer 130, a conductive layer 140, a second antenna layer 150, at least one routing layer 160, at least one feeding pad 162 and at least one dielectric layer 170, at least one first electronic component 180, at least one second electronic component 185, a connector 187 and a molding compound 190.

The first dielectric layer 110 has a first dielectric surface 110*u* and a second dielectric surface 110*b* opposite to the first dielectric surface 110*u* and a first dielectric lateral surface 110*s* extending between the first dielectric surface 110*u* and the second dielectric surface 110*b*. The first antenna layer 120 is formed on the first dielectric surface 110*u*. The grounding layer 130 is formed below the second dielectric surface 110*b*. The conductive layer 140 is formed on the first dielectric lateral surface 110*s* of first dielectric layer 110, wherein the conductive layer 140 is electrically connects to the grounding layer 130 and extends from the grounding layer 130 toward the first antenna layer 120 but not contacts the first dielectric surface 110*u*.

The lateral conductive layer 140 could shield electromagnetic waves from interfering with at least one conductive component (for example, the first electronic component 180, the second electronic component 185 and/or the routing layer 160) surrounded by the conductive layer 140 and decides the size of the antenna module 100.

As shown in Table 1 below, compared to the structure of the conductive layer 140 contacting the first dielectric surface 110*u* or extending to the first dielectric surface 110*u* (call "full lateral conductive layer" in Table 1), the conductive layer 140 of the present embodiment could not contact the first dielectric surface 110*u* or not extend to the first dielectric surface 110*u* (call "partly lateral conductive layer" in Table 1), and thus the antenna gain could reduce to 0.2 dB, and the antenna module size still could maintain in 17% reduction.

TABLE 1

| | Partly lateral conductive layer | Full lateral conductive layer |
|---|---|---|
| Antenna module size | 17% reduction | 17% reduction |
| Antenna Gain | 0.2 dB degradation | 1.1 dB degradation |

The first dielectric layer 110 could be single-layered structure or multi-layered structure. In the present embodiment, the first dielectric layer 110 includes a plurality of sub-dielectric layers, and at least two of the sub-dielectric layers are made by same or different materials. For example, the first dielectric layer 110 includes a first sub-dielectric layer 111 and a plurality of second sub-dielectric layers 112. In an embodiment, the first sub-dielectric layer 111 could be made of a material including FR4, FR5, BT, ceramic, glass, molding compound or liquid crystal polymer, and/or the second sub-dielectric layers 112 could be made of a material including FR4, FR5, BT, ceramic, glass, molding compound or liquid crystal polymer.

As shown in FIG. 1A, at least one the conductive via 115 passes through the first dielectric layer 110 for electrically connecting the second antenna layer 150 with the routing layer 160. For example, the conductive via 115 passes through the first sub-dielectric layer 111. The conductive via 115 is electrically connected to, for example, feeding point. In another embodiment, the conductive via 115 could be omitted, and the signal transmitted by the first electronic component 180 could be coupled to the second antenna layer 150 by using technique of slot-coupled feed.

As shown in FIG. 1B, In the present embodiment, the first antenna layer 120 and the second antenna layer 150 are separated from each other by the second sub-dielectric layers 112. The first antenna layer 120 is patterned antenna layer. For example, the first antenna layer 120 includes a plurality of antenna portion 121 arranged in array of n×m, wherein n is integer equal to or greater than one, and m is integer equal to or greater than one.

As shown in FIG. 1A, in the present embodiment, the grounding layer 130 is formed on the second dielectric surface 110*b* of the first dielectric layer 110 and extends to the first dielectric lateral surface 110*s* of the first dielectric layers 110 for physically (or directly) connecting the conductive layer 140. In another embodiment, the grounding layer 130 could not extend to the first dielectric lateral surface 110*s*, and the grounding layer 130 could be indirectly electrically connected to the conductive layer 140 by another conductive component. In addition, the grounding layer 130 has a plurality of opening 130*a* each receiving the corresponding feeding pad 162 and thus it could prevent the feeding pad 162 from contacting physical material of the grounding layer 130. The feeding pad 162 and the grounding layer 130 could be formed in, for example, the same layer. In addition, the grounding layer 130 is made of a metal including, for example, aluminum, copper, gold, silver, iron or a combination thereof.

As shown in FIG. 1A, the conductive layer 140 further extends in a surface of the at least one second dielectric layer 170. Furthermore, the conductive layer 140 covers a second dielectric lateral surface 170*s* of at least one second dielectric layer 170 and the molding compound 190. As a result, the conductive layer 140 could shield electromagnetic waves from interfering with at least one conductive component (for example, the first electronic component 180 and/or the routing layer 160) within the second dielectric layer 170 and the molding compound 190. As shown in FIGS. 1B and 1C, the conductive layer 140 closely surrounds the first dielectric layer 110, the second dielectric layer 170 and the molding compound 190.

As shown in FIG. 1A, the second antenna layer 150 is formed within the first dielectric layer 110. In the present embodiment, the second antenna layer 150 is formed on one of the sub-dielectric layers, for example, an upper surface 111*u* of the first sub-dielectric layer 111. In another embodiment, the second antenna layer 150 is formed on an upper surface of the second sub-dielectric layer 112.

As shown in FIG. 1A, each routing layer 160 is, for example, a patterned layer. For example, each routing layer 160 includes at least one conductive trace 161, wherein the conductive trace 161 of one of the routing layers 160 could be electrically with the conductive trace 161 of another of the routing layers 160 through at least one conductive via 163.

As shown in FIG. 1A, a plurality of the second dielectric layers 170 are formed under the second dielectric surface 110*b*, and one of a plurality of the routing layers 160 is formed on a surface of the corresponding second dielectric layer 170. The routing layers 160 are separated by the corresponding second dielectric layer 170.

As shown in FIG. 1A, the first electronic component 180 is disposed on and electrically connected to at least one of the routing layers 160. The first electronic component 180 is electrically connected to the second antenna layer 150 through the routing layer 160. The molding compound 190 is formed on the routing layer 160 and encapsulates the first electronic component 180 and the second electronic component 185. In an embodiment, the first electronic component 180 is, for example, RFIC (Radio Frequency Integrated Circuit); however, such exemplification is not meant to be for limiting.

As shown in FIG. 1A, the second electronic component 185 is disposed on and electrically connected to the routing layer 160. The second electronic component 185 is electrically connected to the second antenna layer 150 through the routing layer 160. In an embodiment, the second electronic component 185 is, for example, passive component, for example, resistor, inductor and/or capacitor; however, such exemplification is not meant to be for limiting.

As shown in FIG. 1A, the connector 187 is disposed on and electrically connected to the routing layer 160. The connector 187 is electrically connected to the first electronic component 180 and/or the second electronic component 185 through the routing layer 160. the routing layer 160 exposes a portion 160A not coved by the molding compound 190, and the connector 187 is disposed on the portion 160A of the routing layer 160 and electrically connected with the conductive trace 161 of one of the routing layers 160. The antenna module 100 is electrically connected with an external component (not illustrated) through the connector 187, wherein the external component is, for example, a printed circuit board.

As shown in FIG. 1A, the molding compound 190 includes a molding lateral surface 190*s* and a molding lower surface 190*b* which together define the outer boundary of the molding compound 190. The conductive layer 140 covers the molding lateral surface 190*s* and the molding lower surface 190*b*. In addition, the molding compound 190 could be made of a material including, for example, a Novolac-based resin, an epoxy-based resin, a silicone-based resin, or another suitable encapsulant. Suitable fillers also can be included, such as powdered SiO2. The molding compound 190 can be applied using any of a number of molding techniques, such as compression molding, injection molding, or transfer molding.

Figure 2:
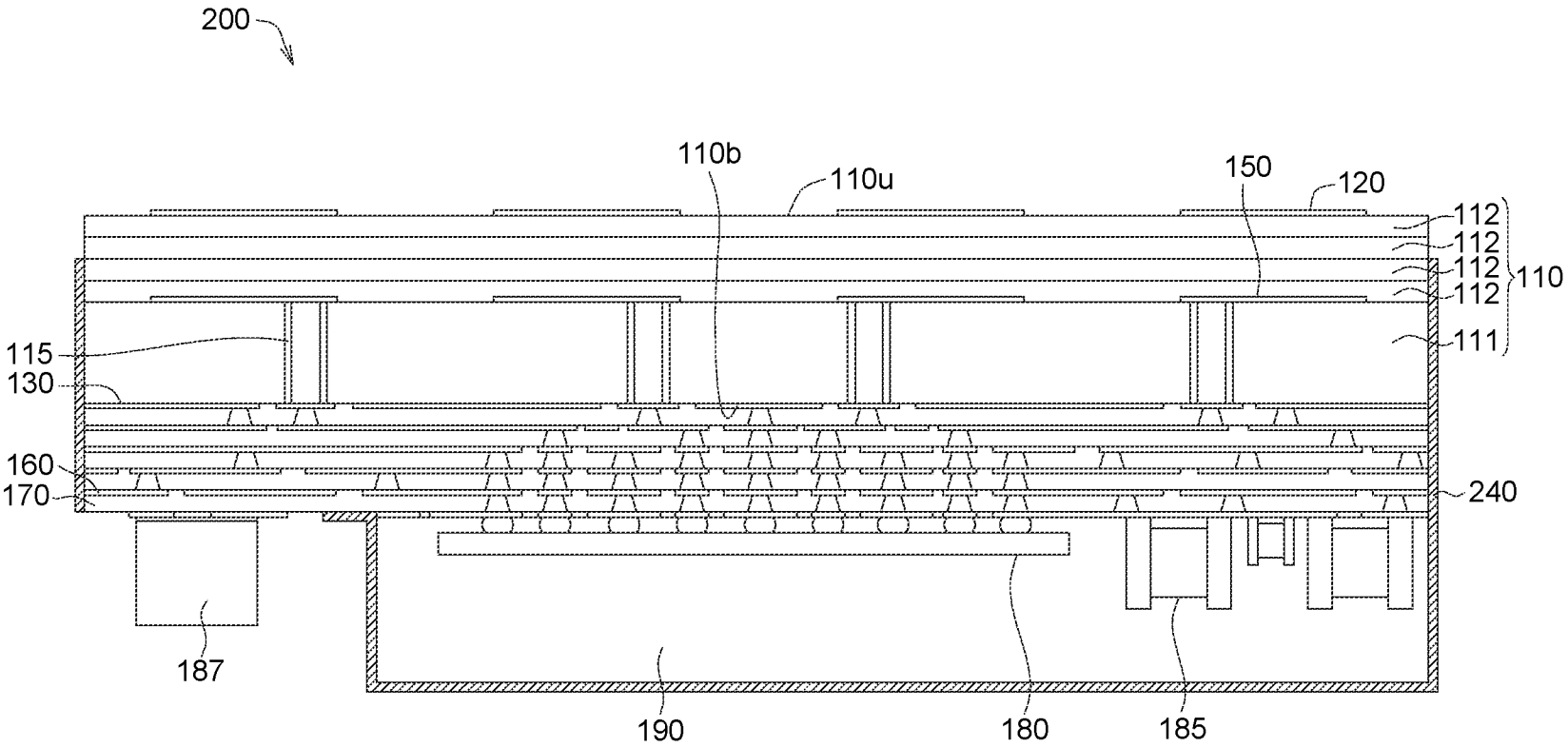
FIG. 2 illustrates a diagram view of an antenna module according to another embodiment of the invention.

Referring to FIG. 2, FIG. 2 illustrates a diagram view of an antenna module 200 according to another embodiment of the invention.

The antenna module 200 includes the first dielectric layer 110, at least one conductive via 115, the first antenna layer 120, the grounding layer 130, the conductive layer 240, the second antenna layer 150, at least one routing layer 160 and at least one dielectric layer 170, at least one first electronic component 180, at least one second electronic component 185, the connector 187 and the molding compound 190.

The conductive layer 240 of the antenna module 200 includes the features same as or similar to that of the conductive layer 140 of the antenna module 100 expect that the conductive layer 240 further extend between the first dielectric surface 110*u* and the second dielectric surface 1110*b* or extend between the first dielectric surface 110*u* and the second antenna layer 150.

Figure 3A:
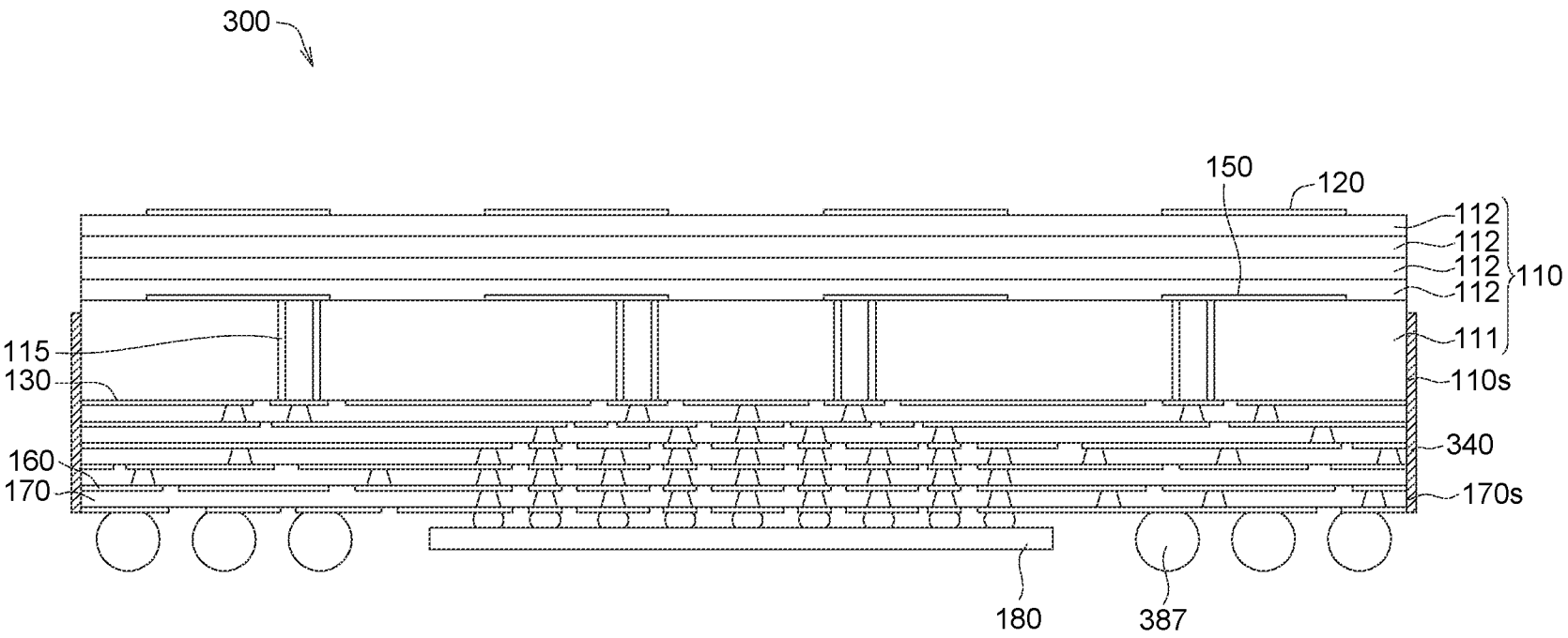
FIG. 3A illustrates a diagram view of an antenna module according to another embodiment of the invention.
Figure 3B:
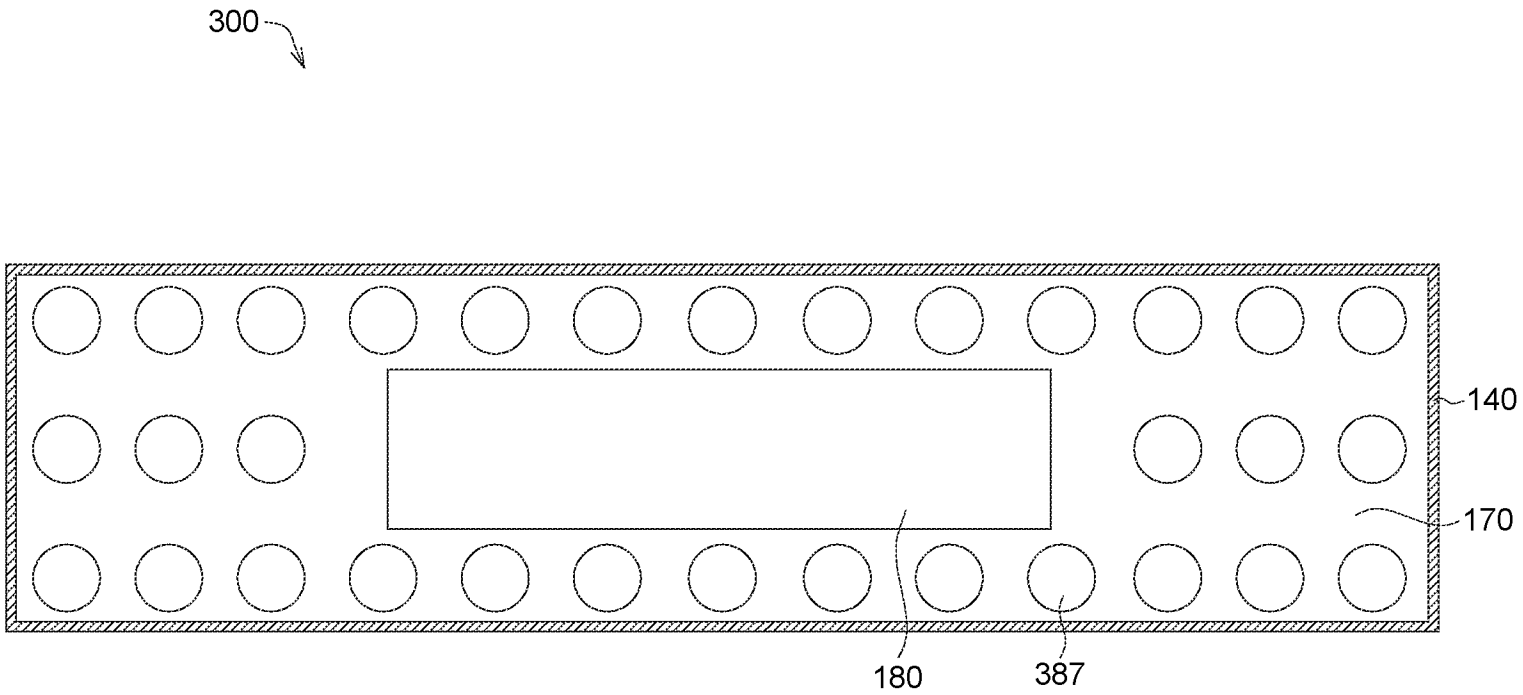
FIG. 3B illustrates a bottom view of the antenna module of FIG. 3A.

Referring to FIGS. 3A and 3B, FIG. 3A illustrates a diagram view of an antenna module 300 according to another embodiment of the invention, and FIG. 3B illustrates a bottom view of the antenna module 300 of FIG. 3A.

As illustrated in FIG. 3A, the antenna module 300 includes the first dielectric layer 110, at least one conductive via 115, the first antenna layer 120, the grounding layer 130, the conductive layer 340, the second antenna layer 150, at least one routing layer 160 and at least one dielectric layer 170, at least one first electronic component 180, at least one second electronic component 185 (not illustrated, selectively) and at least one contact 387.

As illustrated in FIG. 3A, the conductive layer 340 is electrically connects to the grounding layer 130 and is formed on the first dielectric lateral surface 110*s* of first dielectric layer 110 and the second dielectric lateral surface 170*s* of each second dielectric layer 170.

As illustrated in FIG. 3A, the contact 387 is, for example, solder ball, solder paste, conductive pillar, etc. A plurality of the contacts 387 is disposed on the routing layer 160. The antenna module 300 is electrically connected to an external component through the contacts 387, wherein the external component is, for example, a printed circuit board. In the present embodiment, the first electronic component 180 and the contacts 387 are disposed on the same side of the routing layer 160. For example, the contacts 387 and the first electronic component 180 are disposed on the bottommost routing layer 160. In addition, one of the routing layers 160 is electrically grounded through one of the contacts 387, so that the grounding layer 130 is electrically grounded through the routing layer 160 and one of the contacts 387.

Figure 4:
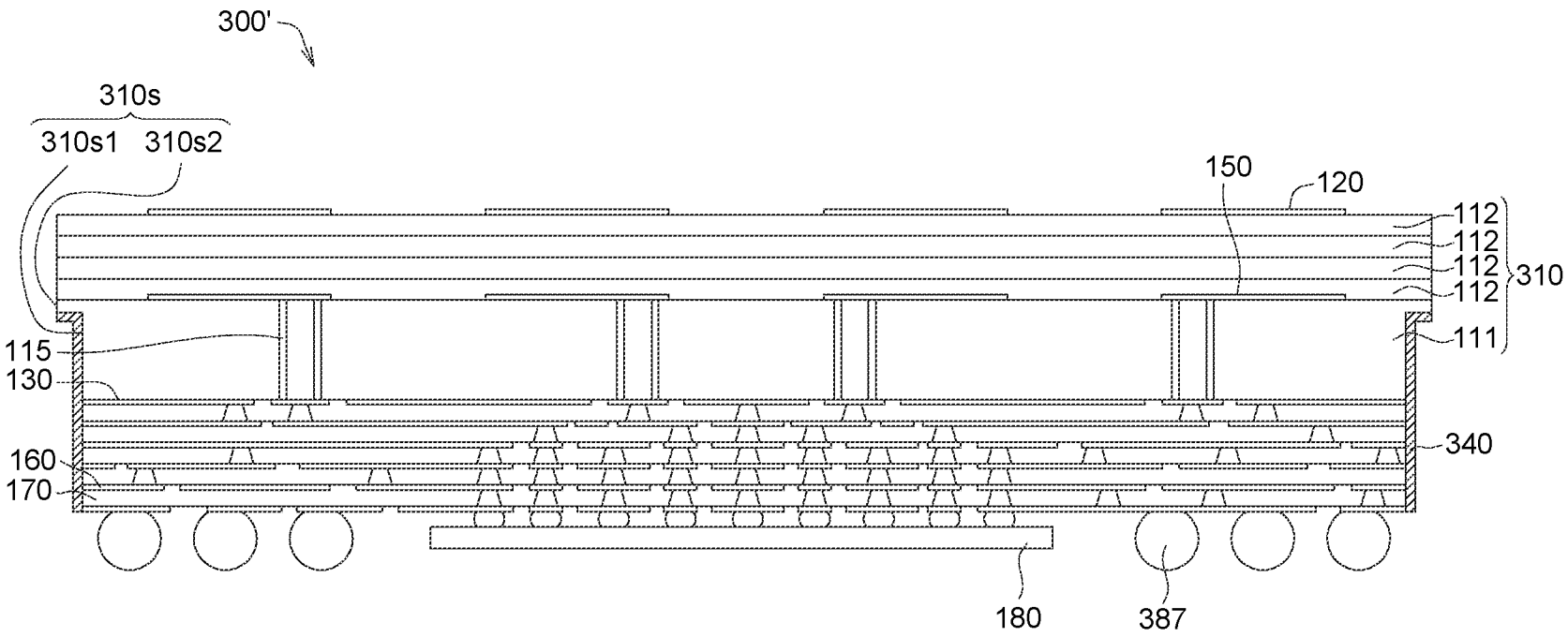
FIG. 4 illustrates a diagram view of an antenna module according to another embodiment of the invention.

Referring to FIG. 4, FIG. 4 illustrates a diagram view of an antenna module 300' according to another embodiment of the invention. The antenna module 300' includes a first dielectric layer 310, at least one conductive via 115, the first antenna layer 120, the grounding layer 130, the conductive layer 340, the second antenna layer 150, at least one routing layer 160 and at least one dielectric layer 170, at least one first electronic component 180, at least one second electronic component 185 (not illustrated, selectively) and at least one contact 387. In the present embodiment, the first dielectric layer 310 has a first dielectric lateral surface 310*s* including a first lateral surface 310*s*1 and a second lateral surface 310*s*2 not aligned with the first lateral surface 310*s*1. In other words, the first lateral surface 310*s*1 and the second lateral surface 310*s*2 are not non-coplanar.

Figure 5:
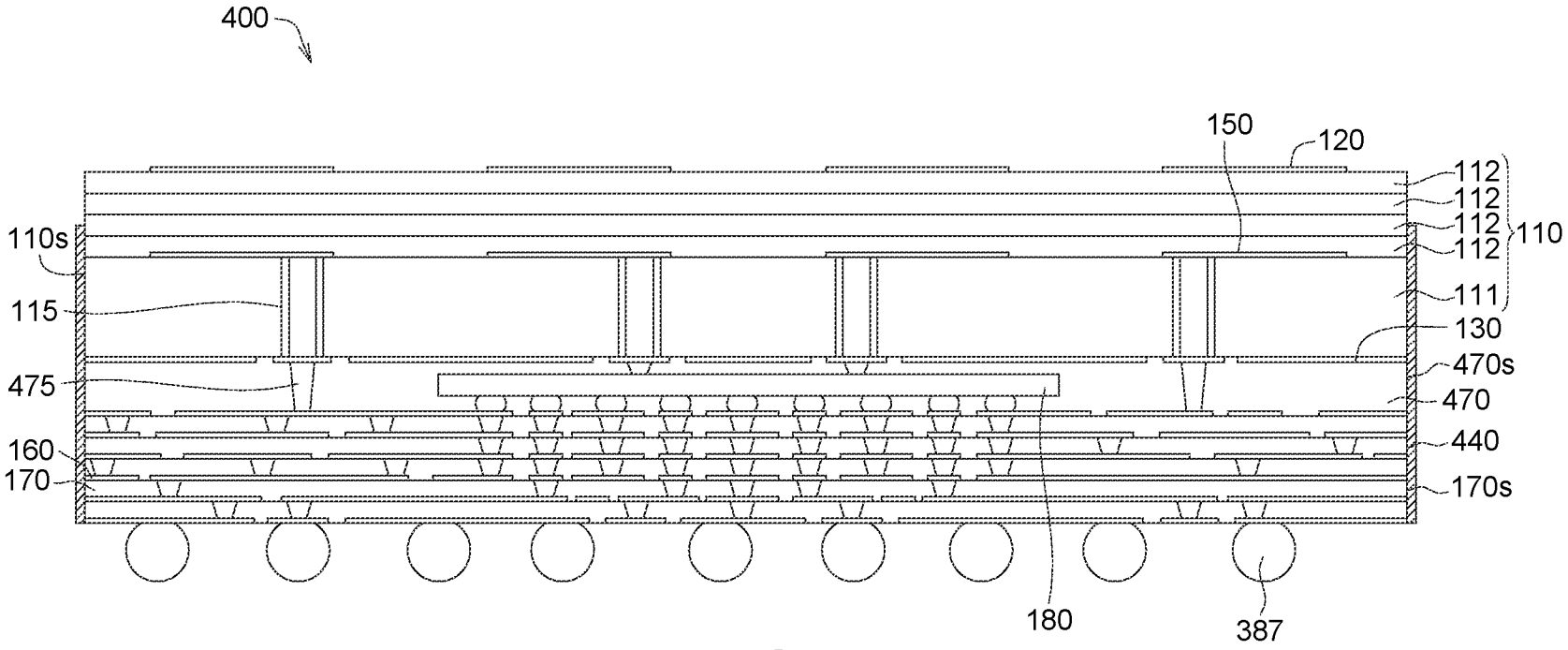
FIG. 5 illustrates a diagram view of an antenna module according to another embodiment of the invention.

Referring to FIG. 5, FIG. 5 illustrates a diagram view of an antenna module 400 according to another embodiment of the invention.

As illustrated in FIG. 5, the antenna module 400 includes the first dielectric layer 110, at least one conductive via 115, the first antenna layer 120, the grounding layer 130, the conductive layer 440, the second antenna layer 150, at least one routing layer 160 and at least one dielectric layer 170, at least one first electronic component 180, at least one second electronic component 185 (not illustrated) and at least one contact 387, a third dielectric layer 470 and at least one conductive via 475.

As illustrated in FIG. 5, the conductive layer 440 is electrically connects to the grounding layer 130 and is formed on the first dielectric lateral surface 110*s* of first dielectric layer 110, the second dielectric lateral surface 170*s* of each second dielectric layer 170 and a third dielectric lateral surface 470*s* of the third dielectric layer 470.

As illustrated in FIG. 5, the first electronic component 180 and the contact 387 are disposed on opposite two sides of the routing layer 160. The third dielectric layer 470 is disposed between the routing layer 160 and the first dielectric layer 110 and encapsulating the first electronic component 180. In an embodiment, the third dielectric layer 470 could be made of a material including FR4, FR5, BT or molding compound. At least one conductive via 475 passes through the third dielectric layer 470 and electrically connects one of the routing layers 160 and the conductive via 115.

Figure 6:
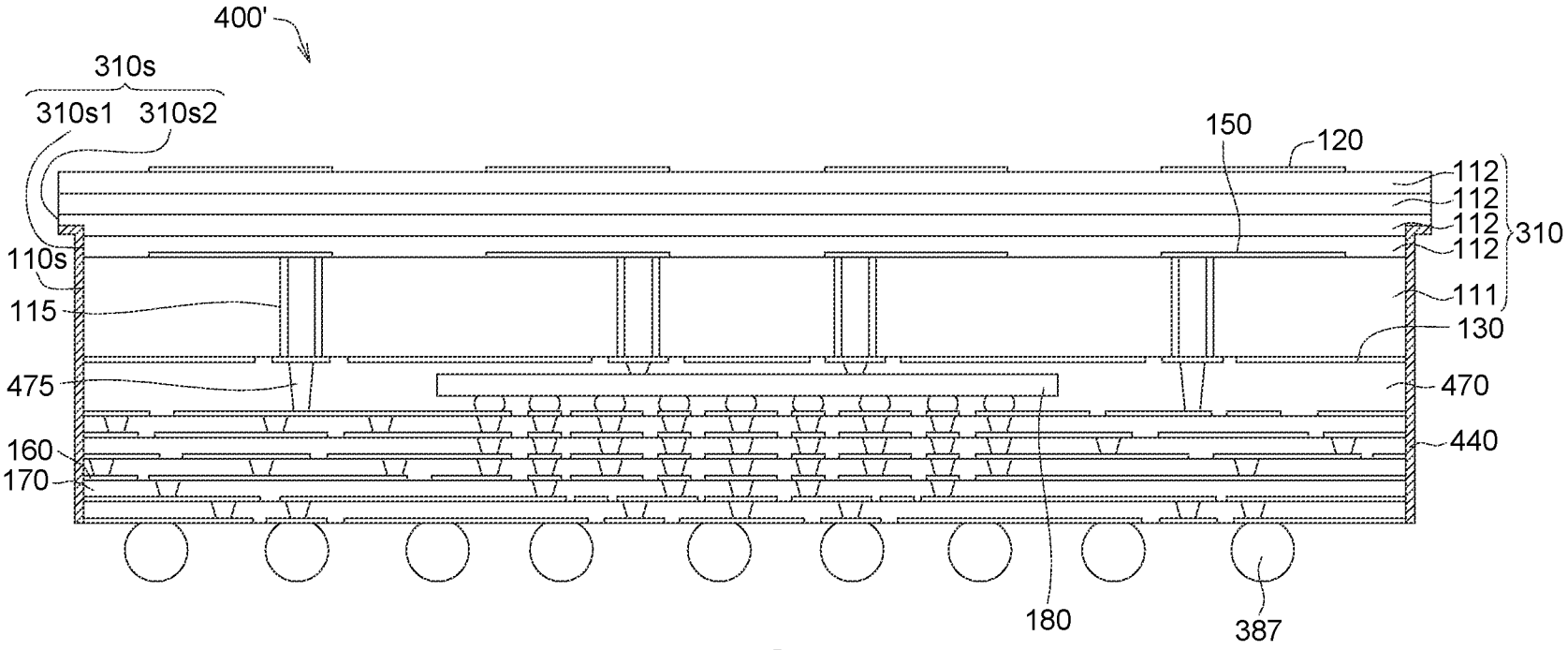
FIG. 6 illustrates a diagram view of an antenna module according to another embodiment of the invention.

Referring to FIG. 6, FIG. 6 illustrates a diagram view of an antenna module 400' according to another embodiment of the invention. The antenna module 400' includes a first dielectric layer 310, at least one conductive via 115, the first antenna layer 120, the grounding layer 130, the conductive layer 340, the second antenna layer 150, at least one routing layer 160 and at least one dielectric layer 170, at least one first electronic component 180, at least one second electronic component 185 (not illustrated, selectively) and at least one contact 387. In the present embodiment, the first dielectric layer 310 has the first dielectric lateral surface 310*s* including the first lateral surface 310*s*1 and the second lateral surface 310*s*2 not aligned with the first lateral surface 310*s*1. In other words, the first lateral surface 310*s*1 and the second lateral surface 310*s*2 are not non-coplanar.

Figure 7:
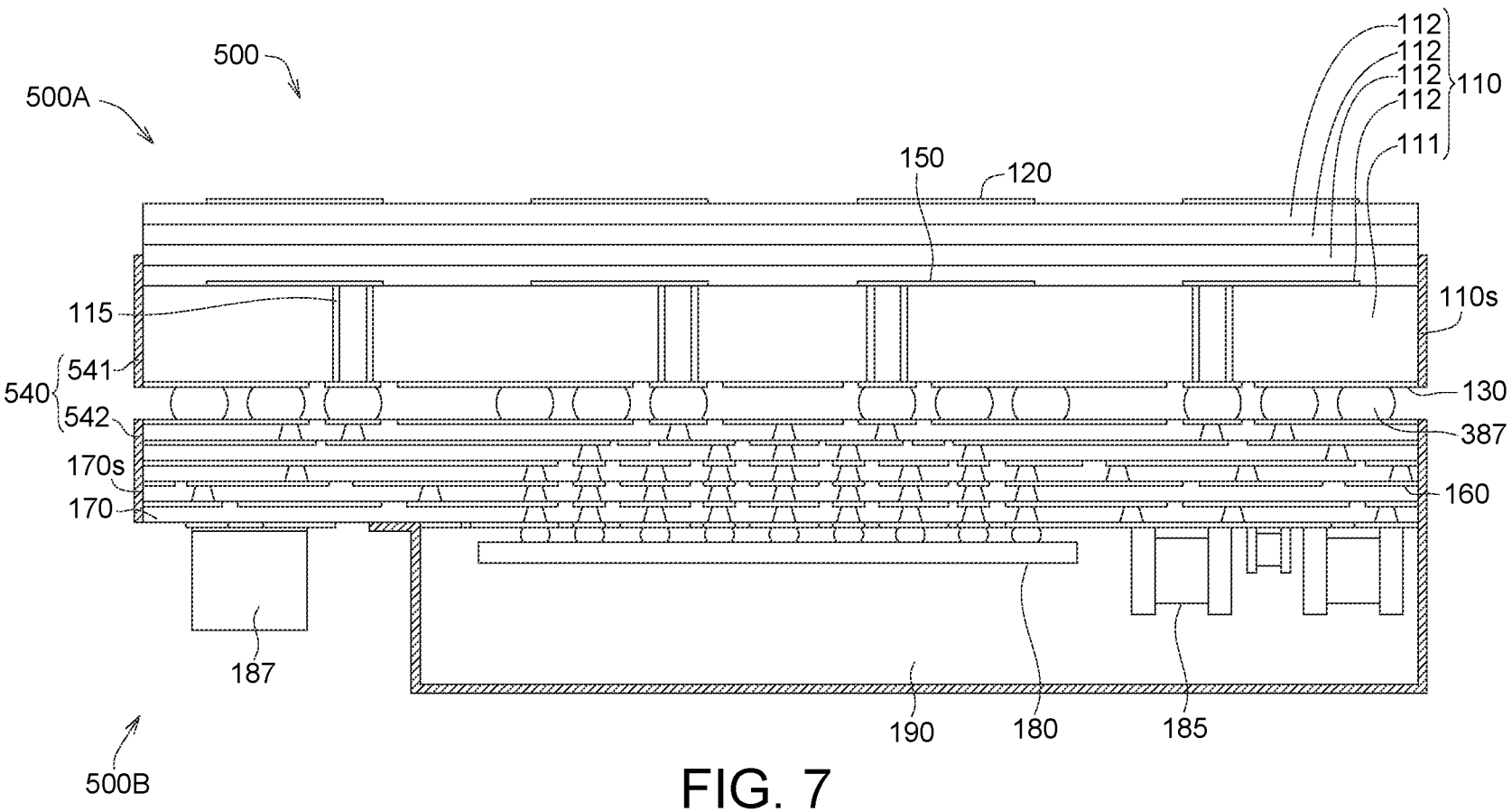
FIG. 7 illustrates a diagram view of an antenna module according to another embodiment of the invention.

Referring to FIG. 7, FIG. 7 illustrates a diagram view of an antenna module 500 according to another embodiment of the invention.

As illustrated in FIG. 7, the antenna module 500 includes the first dielectric layer 110, at least one conductive via 115, the first antenna layer 120, the grounding layer 130, a conductive layer 540, the second antenna layer 150, at least one routing layer 160 and at least one dielectric layer 170, at least one first electronic component 180, at least one second electronic component 185, the connector 187, the molding compound 190, at least one second electronic component 185 and at least one contact 387.

As illustrated in FIG. 7, the conductive layer 540 is electrically connects to the grounding layer 130 and is formed on the first dielectric lateral surface 110*s* of first dielectric layer 110, the second dielectric lateral surface 170*s* of each second dielectric layer 170 and the molding compound 190. In present embodiment, the conductive layer 540 includes a first conductive layer 541 and a second conductive layer 542 wherein the first conductive layer 541 is formed on the first dielectric lateral surface 110*s* of first dielectric layer 110, and the second conductive layer 542 is formed on the second dielectric lateral surface 170*s* of each second dielectric layer 170 and the molding compound 190. The first conductive layer 541 could generate the same effect similar to that in Table 1, and the second conductive layer 542 could shield electromagnetic waves from interfering with the components within the molding compound 190.

In the present embodiment, the first dielectric layer 110, at least one conductive via 115, the first antenna layer 120, the grounding layer 130, the second antenna layer 150 and the first conductive layer 541 are formed in/on a substrate 500A, and the second conductive layer 542, at least one routing layer 160, at least one dielectric layer 170, at least one first electronic component 180, at least one second electronic component 185, the connector 187 and the molding compound 190 form a package 500B, wherein the substrate 500A and the package 500B are disposed oppositely and electrically connected by the contact 387.

Figure 8:
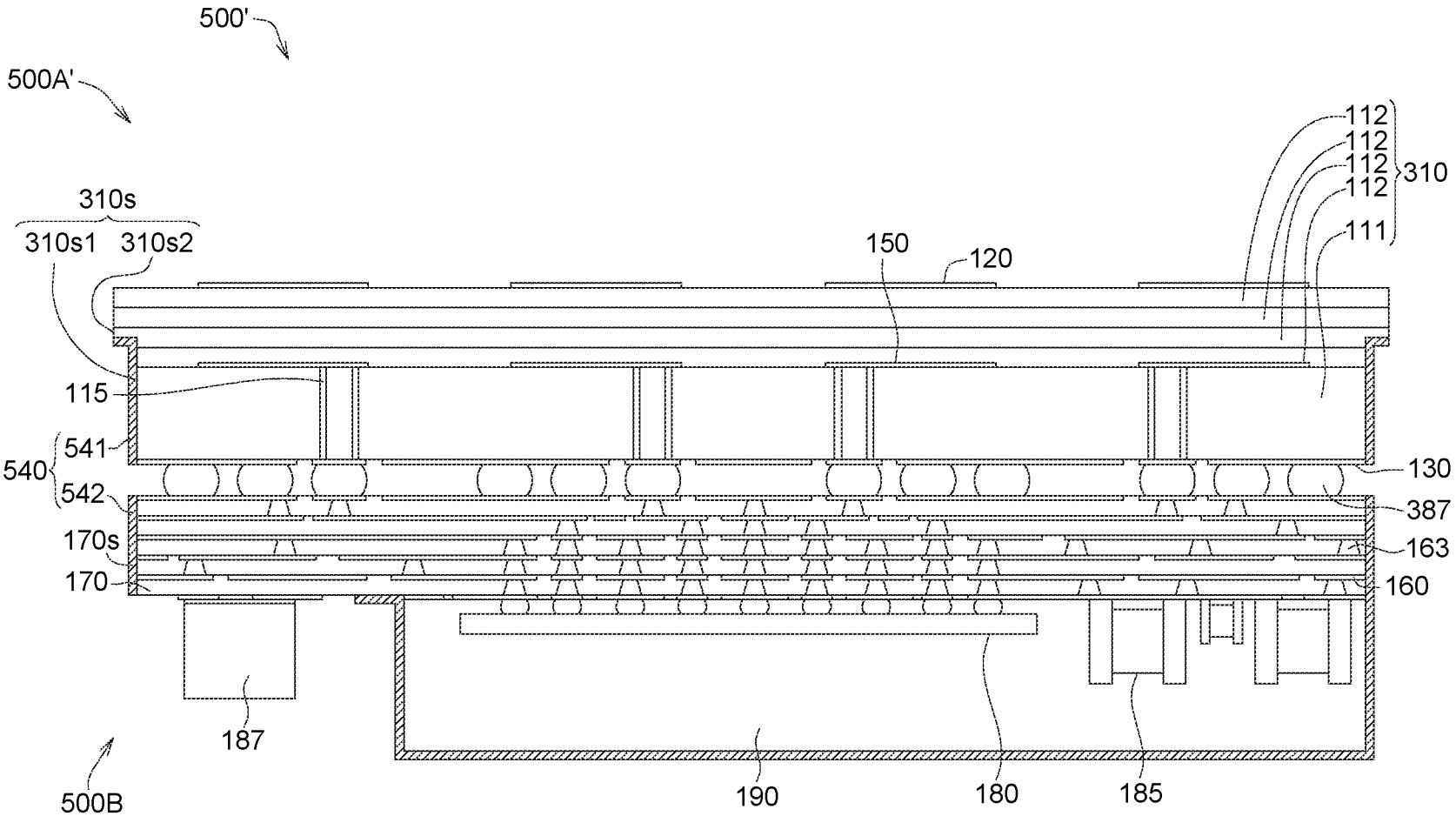
FIG. 8 illustrates a diagram view of an antenna module according to another embodiment of the invention.

Referring to FIG. 8, FIG. 8 illustrates a diagram view of an antenna module 500' according to another embodiment of the invention. The antenna module 500' includes the first dielectric layer 310, at least one conductive via 115, the first antenna layer 120, the grounding layer 130, the conductive layer 540, the second antenna layer 150, at least one routing layer 160 and at least one dielectric layer 170, at least one first electronic component 180, at least one second electronic component 185, the connector 187, the molding compound 190, at least one second electronic component 185 and at least one contact 387. In the present embodiment, the first dielectric layer 310 has the first dielectric lateral surface 310*s* including the first lateral surface 310*s*1 and the second lateral surface 310*s*2 not aligned with the first lateral surface 310*s*1. In other words, the first lateral surface 310*s*1 and the second lateral surface 310*s*2 are not non-coplanar.

In the present embodiment, the first dielectric layer 310, at least one conductive via 115, the first antenna layer 120, the grounding layer 130, the second antenna layer 150 and the first conductive layer 541 are formed in/on a substrate 500A', and the second conductive layer 542, at least one routing layer 160, at least one dielectric layer 170, at least one first electronic component 180, at least one second electronic component 185, the connector 187 and the molding compound 190 form the package 500B, wherein the substrate 500A' and the package 500B are disposed oppositely and electrically connected by the contact 387. In addition, in the present invention, the at least one routing layer 160, the at least one dielectric layer 170 and the at least one conductive via 163 could be regarded as/serves as another substrate.

In addition, in another embodiment, the grounding layer 130 could be disposed on one of the dielectric layers 170. For example, the grounding layer 130 could be disposed on the topmost dielectric layers 170.

Figure 9:
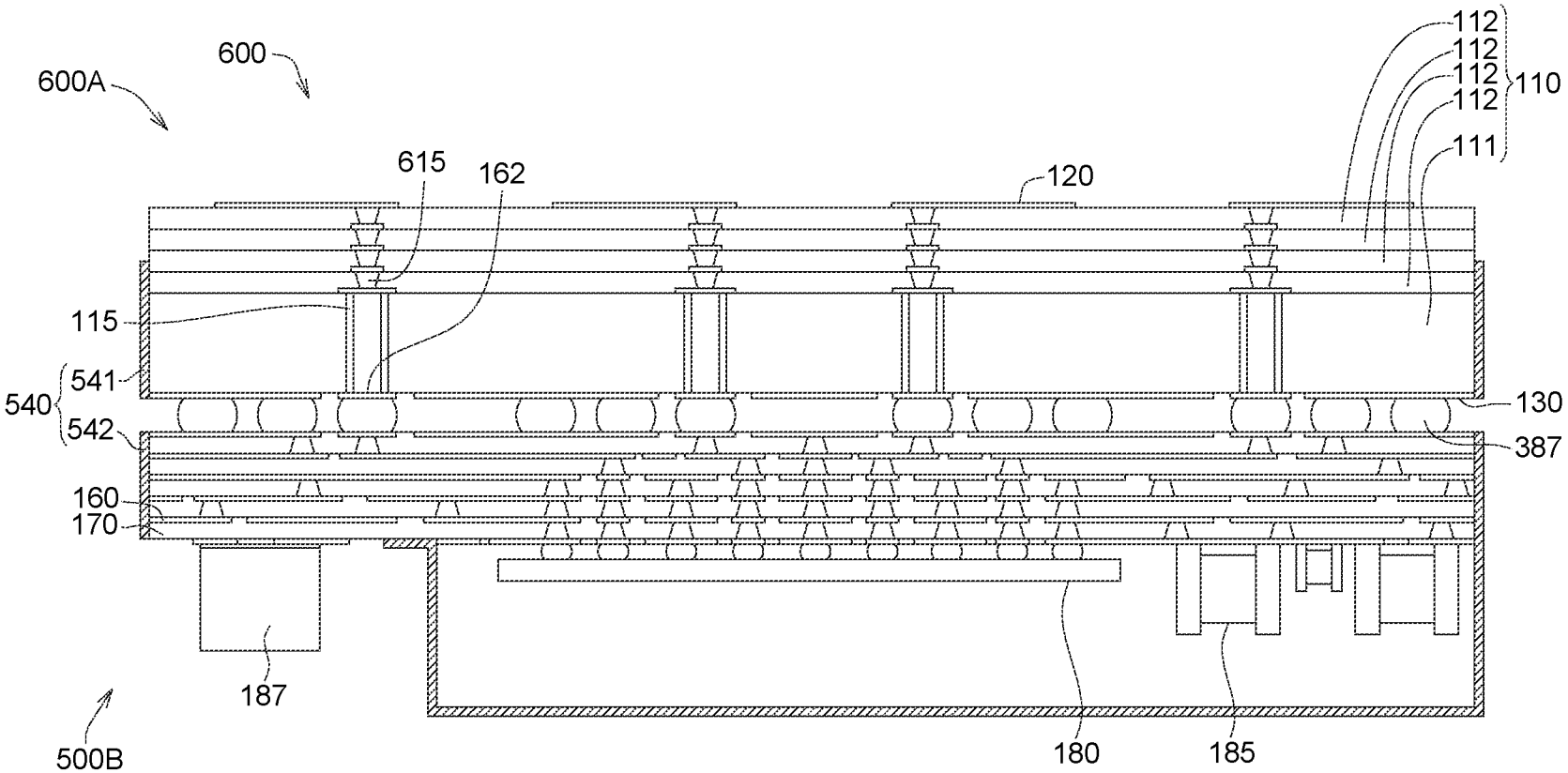
FIG. 9 illustrates a diagram view of an antenna module according to another embodiment of the invention.

Referring to FIG. 9, FIG. 9 illustrates a diagram view of an antenna module 600 according to another embodiment of the invention.

As illustrated in FIG. 9, the antenna module 600 includes the first dielectric layer 110, at least one conductive via 115, at least one conductive via 615, the first antenna layer 120, the grounding layer 130, the conductive layer 540, at least one routing layer 160, at least one feeding pad 162, at least one dielectric layer 170, at least one first electronic component 180, at least one second electronic component 185, the connector 187, the molding compound 190, at least one second electronic component 185 and at least one contact 387.

In the present embodiment, as illustrated in FIG. 9, the conductive via 115 and a plurality of the conductive via 615 together pass through the first dielectric layer 110 and electrically connecting the first antenna layer 120 and the feeding pad 162.

In the present embodiment, the first dielectric layer 110, at least one conductive via 115, the first antenna layer 120, the grounding layer 130, the second antenna layer 150, the first conductive layer 541 and at least one conductive via 615 are formed in/on a substrate 600A, and the second conductive layer 542, at least one routing layer 160, at least one dielectric layer 170, at least one first electronic component 180, at least one second electronic component 185, the connector 187 and the molding compound 190 form the package 500B, wherein the substrate 600A and the package 500B are disposed oppositely and electrically connected by the contact 387.

Figure 10:
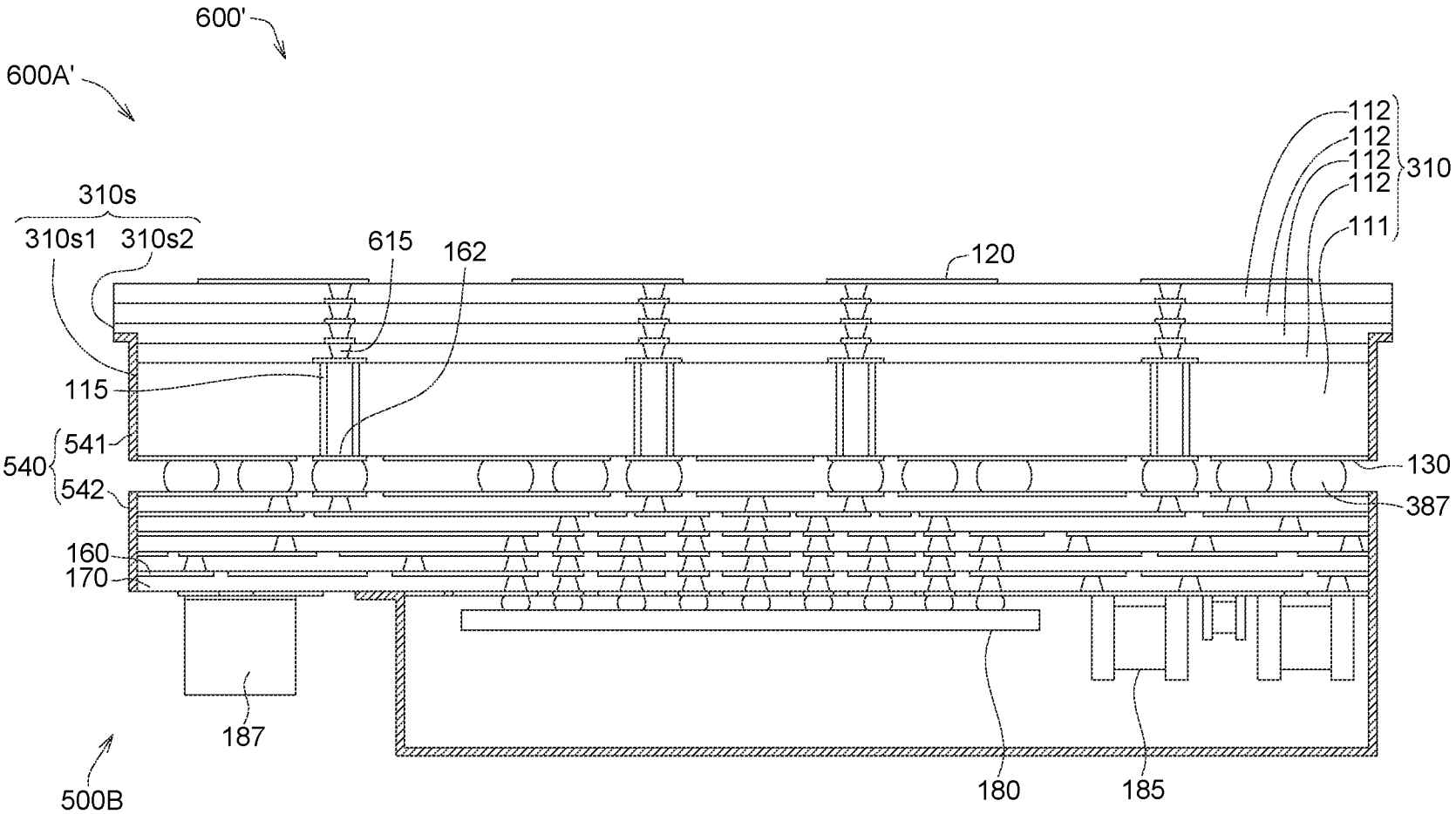
FIG. 10 illustrates a diagram view of an antenna module according to another embodiment of the invention.

Referring to FIG. 10, FIG. 10 illustrates a diagram view of an antenna module 600' according to another embodiment of the invention. The antenna module 600' includes the first dielectric layer 310, at least one conductive via 115, at least one conductive via 615, the first antenna layer 120, the grounding layer 130, the conductive layer 540, at least one routing layer 160, at least one feeding pad 162, at least one dielectric layer 170, at least one first electronic component 180, at least one second electronic component 185, the connector 187, the molding compound 190 and at least one contact 387. In the present embodiment, the first dielectric layer 310 has the first dielectric lateral surface 310*s* including the first lateral surface 310*s*1 and the second lateral surface 310*s*2 not aligned with the first lateral surface 310*s*1. In other words, the first lateral surface 310*s*1 and the second lateral surface 310*s*2 are not non-coplanar.

In the present embodiment, the first dielectric layer 310, at least one conductive via 115, the first antenna layer 120, the grounding layer 130, the second antenna layer 150, the first conductive layer 541 and at least one conductive via 615 are formed in/on a substrate 600A', and the second conductive layer 542, at least one routing layer 160, at least one dielectric layer 170, at least one first electronic component 180, at least one second electronic component 185, the connector 187 and the molding compound 190 form the package 500B, wherein the substrate 600A' and the package 500B are disposed oppositely and electrically connected by the contact 387.

Figure 11:
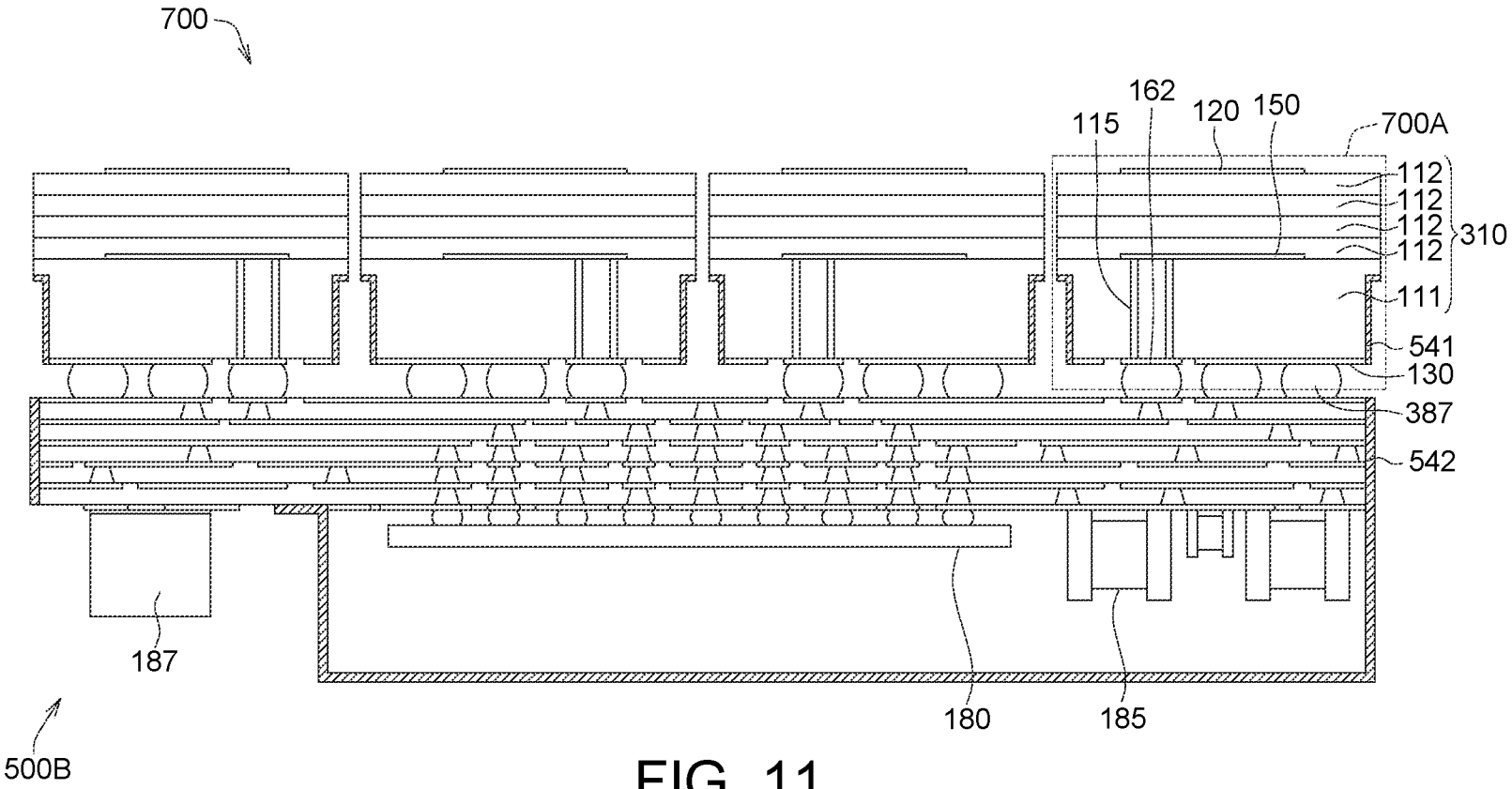
FIG. 11 illustrates a diagram view of an antenna module according to another embodiment of the invention.

Referring to FIG. 11, FIG. 11 illustrates a diagram view of an antenna module 700 according to another embodiment of the invention.

As illustrated in FIG. 11, the antenna module 700 includes a plurality of antenna units 700A, the second substrate 500B and at least one contact 387, wherein the antenna units 700A are spaced from each other, and each antenna unit 700A includes the features similar to or the same as that of the substrate 500A'. For example, each antenna unit 700A includes the first dielectric layer 310, at least one conductive via 115, the first antenna layer 120, the grounding layer 130, the conductive layer 140 and the first conductive layer 541. Each antenna unit 700A is electrically connected with the second substrate 500B by at least one contact 387.

Figure 12:
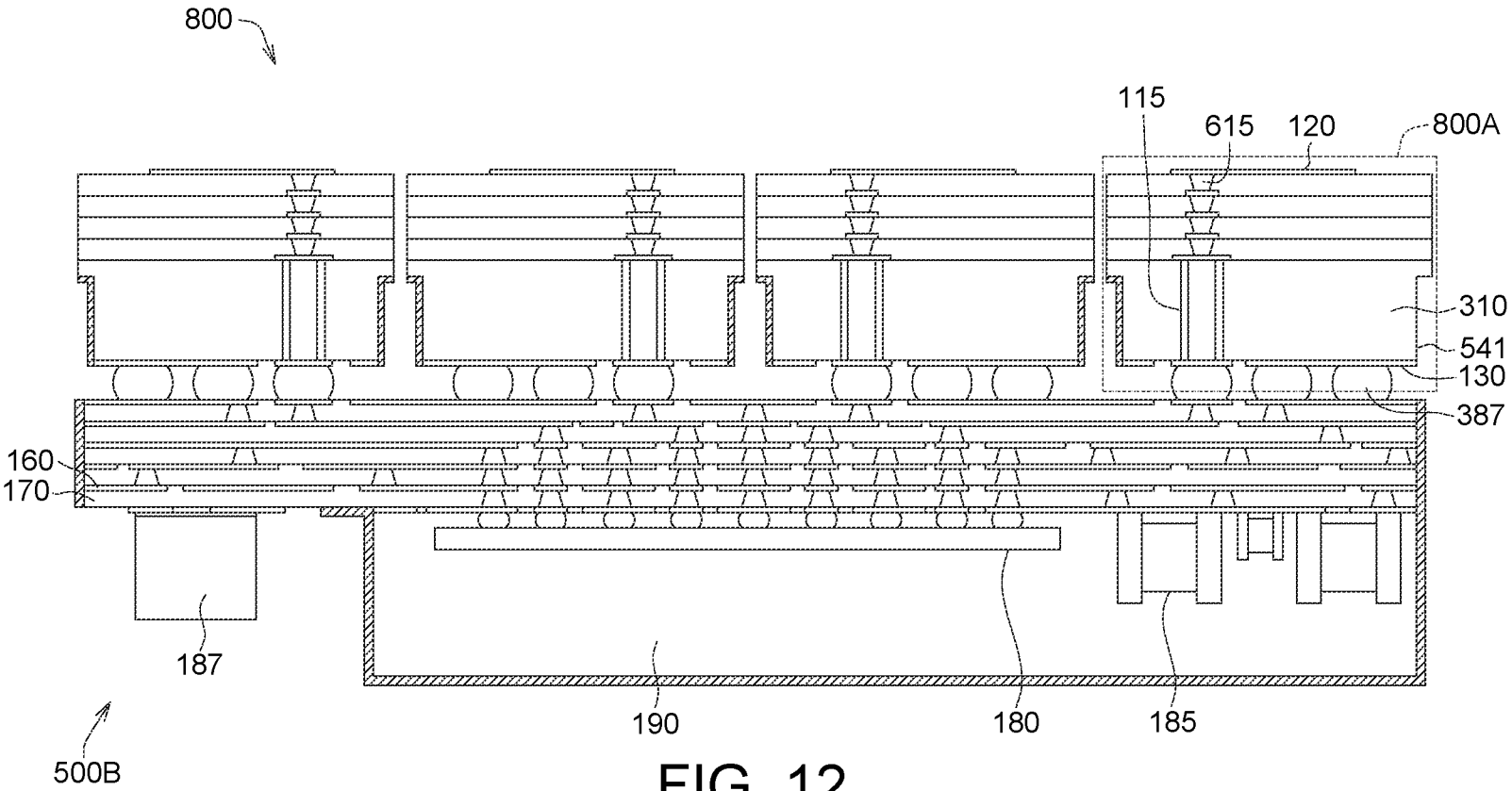
FIG. 12 illustrates a diagram view of an antenna module according to another embodiment of the invention.

Referring to FIG. 12, FIG. 12 illustrates a diagram view of an antenna module 800 according to another embodiment of the invention.

As illustrated in FIG. 12, the antenna module 800 includes a plurality of antenna units 800A, the second substrate 500B and at least one contact 387, wherein the antenna units 800A are spaced from each other, and each antenna unit 800A includes the features similar to or the same as that of the substrate 600A'. For example, each antenna unit 800A includes the first dielectric layer 310, at least one conductive via 115, the first antenna layer 120, the grounding layer 130, the conductive layer 140, the first conductive layer 541 and at least one conductive via 615. Each antenna unit 800A is electrically connected with the second substrate 500B by at least one contact 387.

Figure 13:
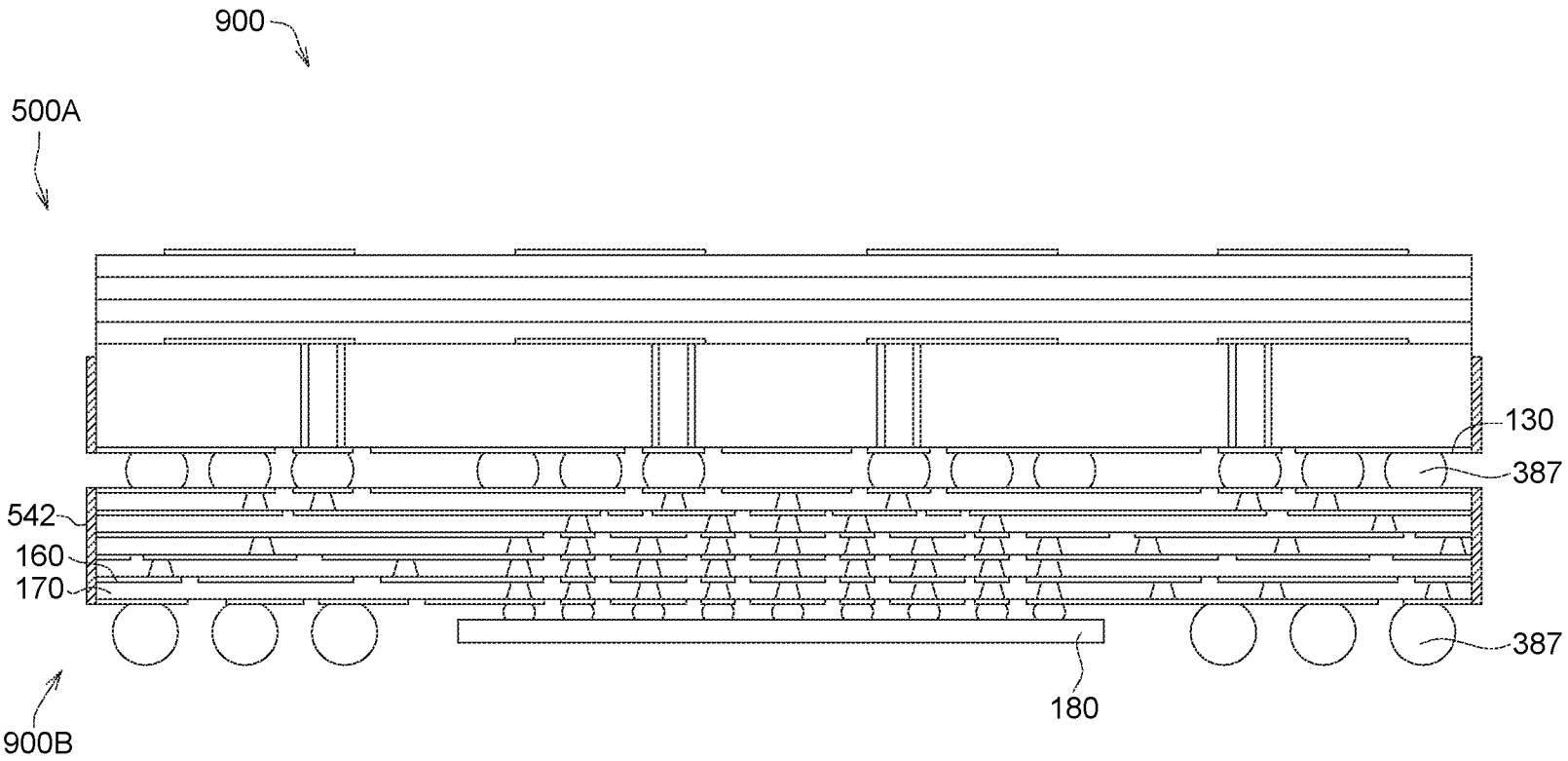
FIG. 13 illustrates a diagram view of an antenna module according to another embodiment of the invention.

Referring to FIG. 13, FIG. 13 illustrates a diagram view of an antenna module 900 according to another embodiment of the invention.

As illustrated in FIG. 13, the antenna module 900 includes the substrate 500A and a package 900B, wherein the package 900B includes the second conductive layer 542, at least one routing layer 160 and at least one dielectric layer 170, at least one first electronic component 180, at least one second electronic component 185 (not illustrated, selectively) and at least one contact 387. The substrate 500A is electrically connected with the package 900B by at least one contact 387.

Figure 14:
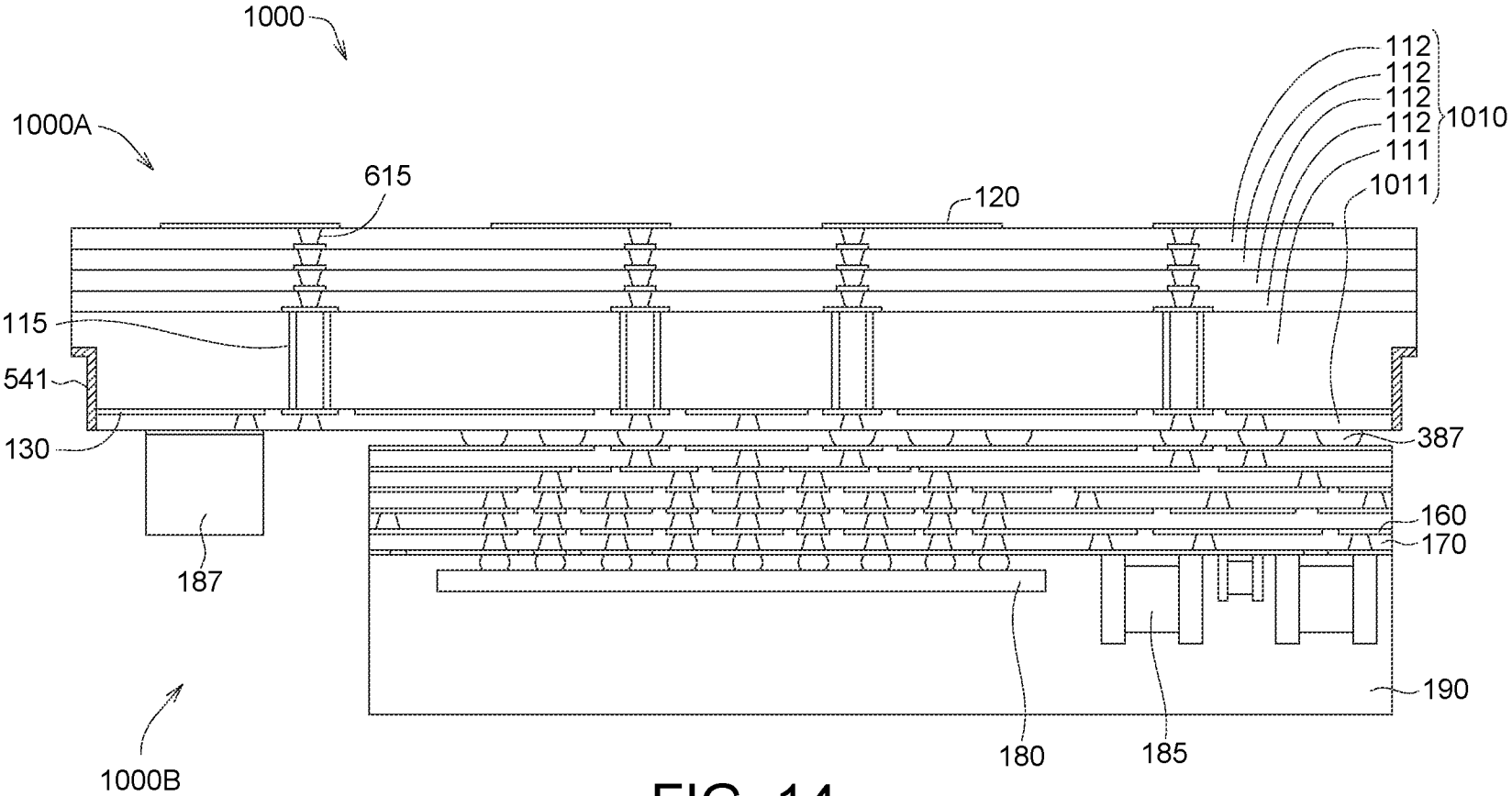
FIG. 14 illustrates a diagram view of an antenna module according to another embodiment of the invention.

Referring to FIG. 14, FIG. 14 illustrates a diagram view of an antenna module 1000 according to another embodiment of the invention.

The antenna module 1000 includes a first dielectric layer 1010, the first antenna layer 120, the grounding layer 130, the first conductive layer 541, the connector 187, at least one conductive via 115, at least one conductive via 615, at least one routing layer 160, at least one feeding pad 162, at least one dielectric layer 170, at least one first electronic component 180, at least one second electronic component 185, the molding compound 190 and at least one contact 387.

The first dielectric layer 1010, the first antenna layer 120, the grounding layer 130, the first conductive layer 541, at least one conductive via 115 and at least one conductive via 615 form a substrate 1000A, and at least one routing layer 160, at least one dielectric layer 170, at least one first electronic component 180, at least one second electronic component 185 and the molding compound 190 form a package 1000B. The package 1000B and the substrate 1000A are electrically connected by at least one contact 387.

In the present embodiment, the connector 187 is disposed on one of the layer of the first dielectric layer 1010, for example, the first sub-dielectric layer 111. The connector 187 and the package 1000B are disposed on the same side of the substrate 1000A.

In addition, the substrate (500A, 500A', 600A, 600A', 700A, 800A or 1000A) and the package (500B, 900B or 1000B) are stacked to form a PoP (Package on Package), wherein the substrate has a size (length and/or width) equal to, greater than or less than that of the package. For example, in antenna module 500 of FIG. 7, the package 500B has a length greater than that of the substrate 500A. In antenna module 1000 of FIG. 14, the substrate 1000A has a length greater than that of the package 1000B.

In addition, the first dielectric layer 1010 further includes at least one forth dielectric layer 1011 formed between the first dielectric layers 111 and the contacts 387 or between the first dielectric layers 111 and the package 1000B. In another embodiment, at least one of routing layer 160 could be formed on a surface of the at least one forth dielectric layer 1011. In addition, the forth dielectric layer 1011 is made of a material same or different from that of the first dielectric layer 111 or the second dielectric layer 112.

In addition, the at least one forth dielectric layer 1011 formed between the first dielectric layers 111 and the contacts 387 or between the first dielectric layers 111 and the package could applied to the substrate 500A, the substrate 500A', the substrate 600A, the substrate 600A', the antenna unit 700A, the antenna unit 800A and/or the substrate 1000A.

Figure 15:
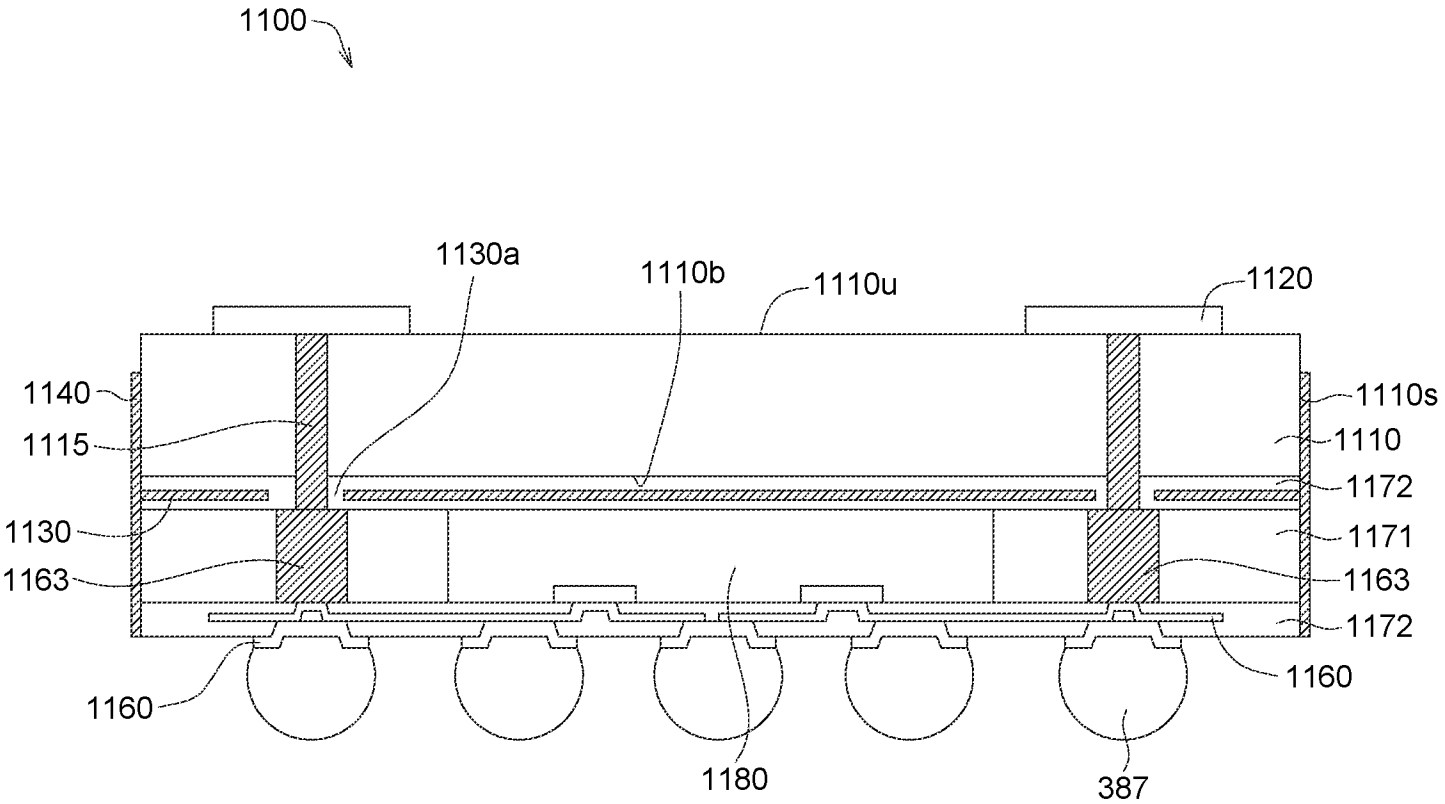
FIG. 15 illustrates a diagram view of an antenna module according to another embodiment of the invention.

Referring to FIG. 15, FIG. 15 illustrates a diagram view of an antenna module 1100 according to another embodiment of the invention.

The antenna module 1100 includes a first dielectric layer 1110, at least one conductive via 1115, a first antenna layer 1120, a grounding layer 1130, a conductive layer 1140, at least one routing layer 1160, at least one conductive via 1163 and a plurality of dielectric layers 1171 and 1172, at least one first electronic component 1180 and at least one contact 387.

The first dielectric layer 1110 has a first dielectric surface 1110*u* and a second dielectric surface 1110*b* opposite to the first dielectric surface 1110*u* and a first dielectric lateral surface 1110*s* extending between the first dielectric surface 1110*u* and the second dielectric surface 1110*b*. The first antenna layer 1120 is formed on the first dielectric surface 1110*u*. The grounding layer 1130 is formed below the second dielectric surface 1110*b*. The conductive layer 1140 is formed on the first dielectric lateral surface 1110*s* of first dielectric layer 1110, wherein the conductive layer 1140 is electrically connects to the grounding layer 1130 and extends from the grounding layer 1130 toward the first antenna layer 1120 but not contacts the first dielectric surface 1110*u*.

In the present embodiment, the first dielectric layer 1110 is, for example, single-layered structure. The dielectric layer 1171 is made of a material same or different from that of the dielectric layer 1172. The grounding layer 1130 is embedded in one of the dielectric layers 1172. The grounding layer 1130 has a plurality of opening 1130*a* each allowing the corresponding conductive via 1115 to pass through. The first electronic component 1180 is electrically connected to the first antenna layer 1120 through the routing layers 1160, the conductive via 1163 and the conductive via 1115. In an embodiment, the first electronic component 1180 is, for example, RFIC (Radio Frequency Integrated Circuit); however, such exemplification is not meant to be for limiting. In an embodiment, the second electronic component 185 is, for example, passive component, for example, resistor, inductor and/or capacitor; however, such exemplification is not meant to be for limiting. The contact 387 is, for example, solder ball, solder paste, conductive pillar, etc. A plurality of the contacts 387 is disposed on the routing layer 1160.

Figure 16:
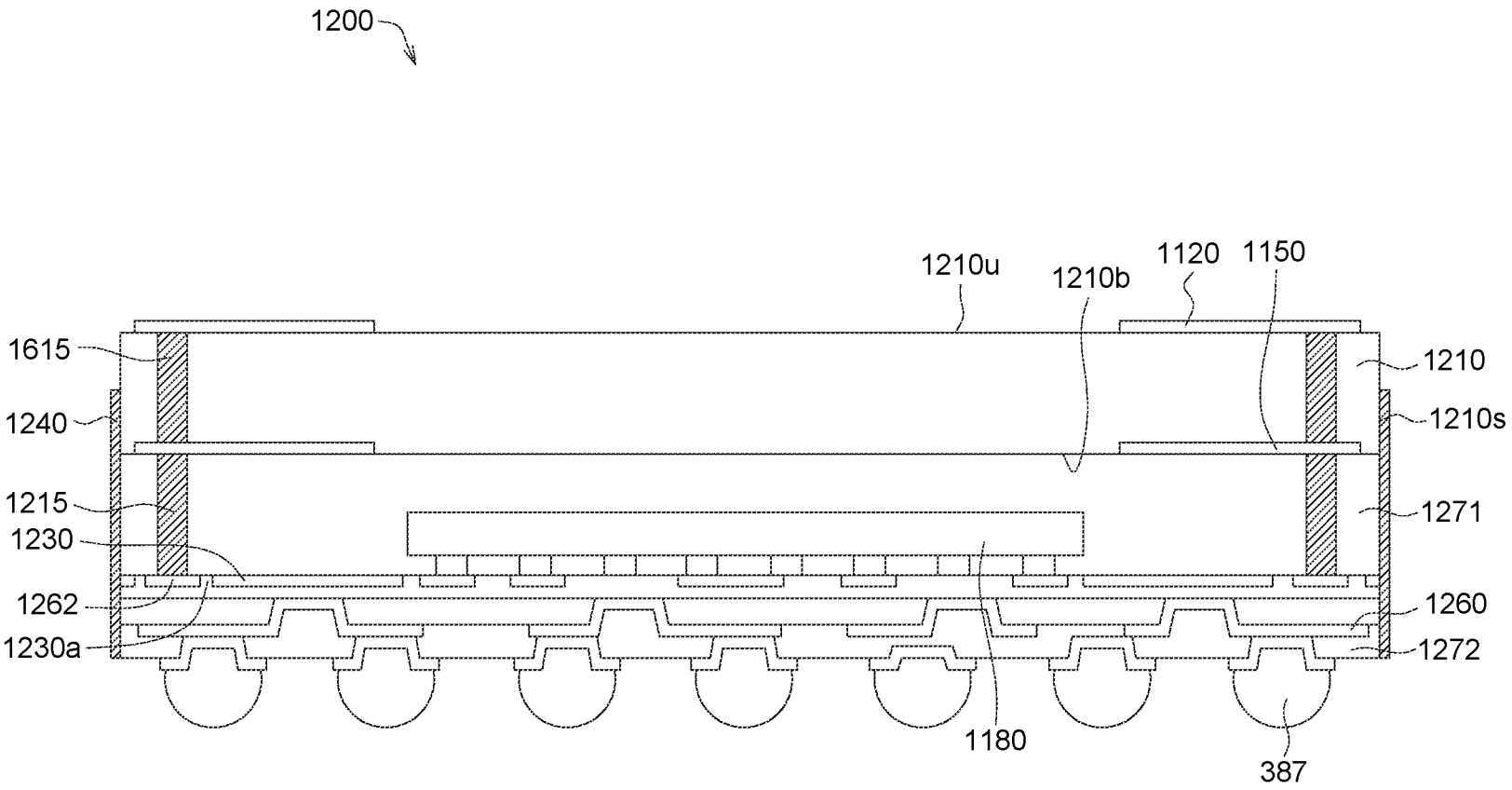
FIG. 16 illustrates a diagram view of an antenna module according to another embodiment of the invention.

Referring to FIG. 16, FIG. 16 illustrates a diagram view of an antenna module 1200 according to another embodiment of the invention.

The antenna module 1200 includes a first dielectric layer 1210, at least one conductive via 1215, a first antenna layer 1220, a grounding layer 1230, a conductive layer 1240, at least one routing layer 1260, at least one conductive via 1615 and a plurality of dielectric layers 1271 and 1272, at least one first electronic component 1280 and at least one contact 387.

The first dielectric layer 1210 has a first dielectric surface 1210*u* and a second dielectric surface 1210*b* opposite to the first dielectric surface 1210*u* and a first dielectric lateral surface 1210*s* extending between the first dielectric surface 1210*u* and the second dielectric surface 1210*b*. The first antenna layer 1220 is formed on the first dielectric surface 1210*u*. The grounding layer 1230 is formed below the second dielectric surface 1210*b*. For example, the grounding layer 1230 is formed in the dielectric layer 1271 or one of the dielectric layers 1272. The conductive layer 1240 is formed on the first dielectric lateral surface 1210*s* of first dielectric layer 1110, wherein the conductive layer 1240 is electrically connects to the grounding layer 1230 and extends from the grounding layer 1230 toward the first antenna layer 1220 but not contacts the first dielectric surface 1210*u*.

In the present embodiment, the dielectric layer 1271 is made of a material different from that of the dielectric layer 1272. The grounding layer 1230 is embedded in one of the dielectric layers 1172. The grounding layer 1230 has a plurality of opening 1230*a* each receiving the corresponding feeding pad 1262 and thus it could prevent the feeding pad 1262 from contacting physical material of the grounding layer 1230. The first electronic component 1180 is electrically connected to the first antenna layer 1220 through the routing layers 1260, the conductive via 1262, the conductive via 1215 and the conductive via 1615.

Referring to FIGS. 17A to 17D, FIGS. 17A to 17D illustrate manufacturing processes of the antenna module 100 of FIG. 1.

Figure 17A:
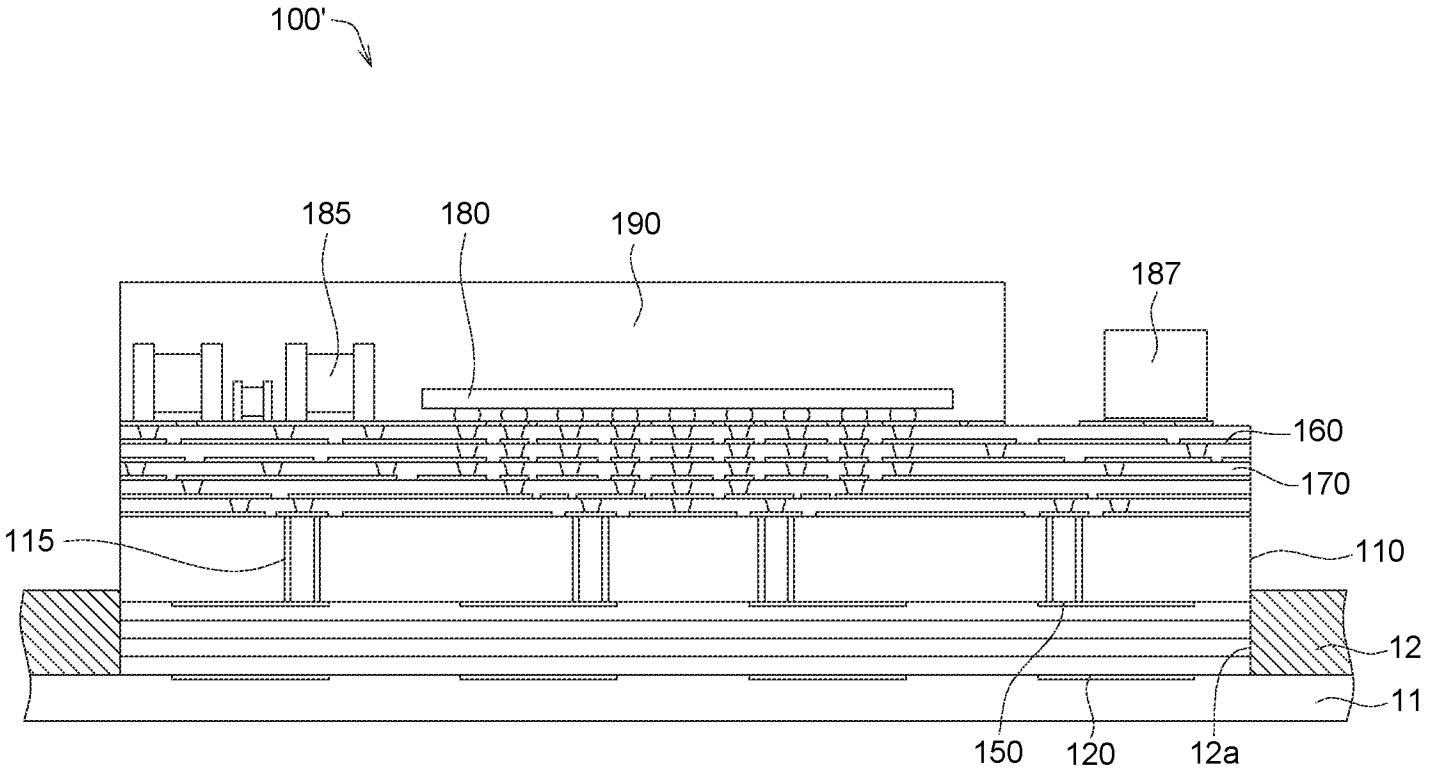
FIGS. 17A to 17D illustrate manufacturing processes of the antenna module of FIG. 1.

As illustrated in FIG. 17A, the structure 100' including the first dielectric layer 110, at least one conductive via 115, the first antenna layer 120, the grounding layer 130, the second antenna layer 150, at least one routing layer 160 and at least one dielectric layer 170, at least one first electronic component 180, at least one second electronic component 185, the connector 187 and molding compound 190 is disposed on an adhesive layer 11 and in a metal frame 12. The metal frame 12 has a penetrating portion 12*a* for receiving a portion of the first dielectric layer 110.

Figure 17B:
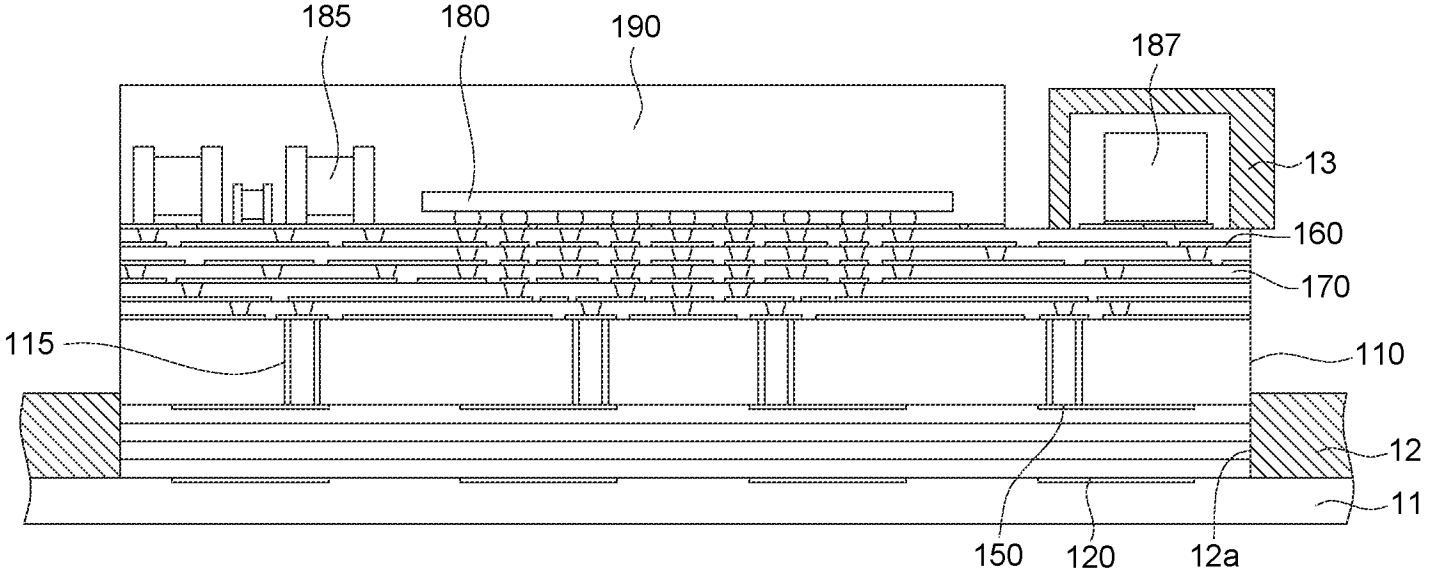

As illustrated in FIG. 17B, a cover 13 is disposed to cover the connector 187.

Figure 17C:
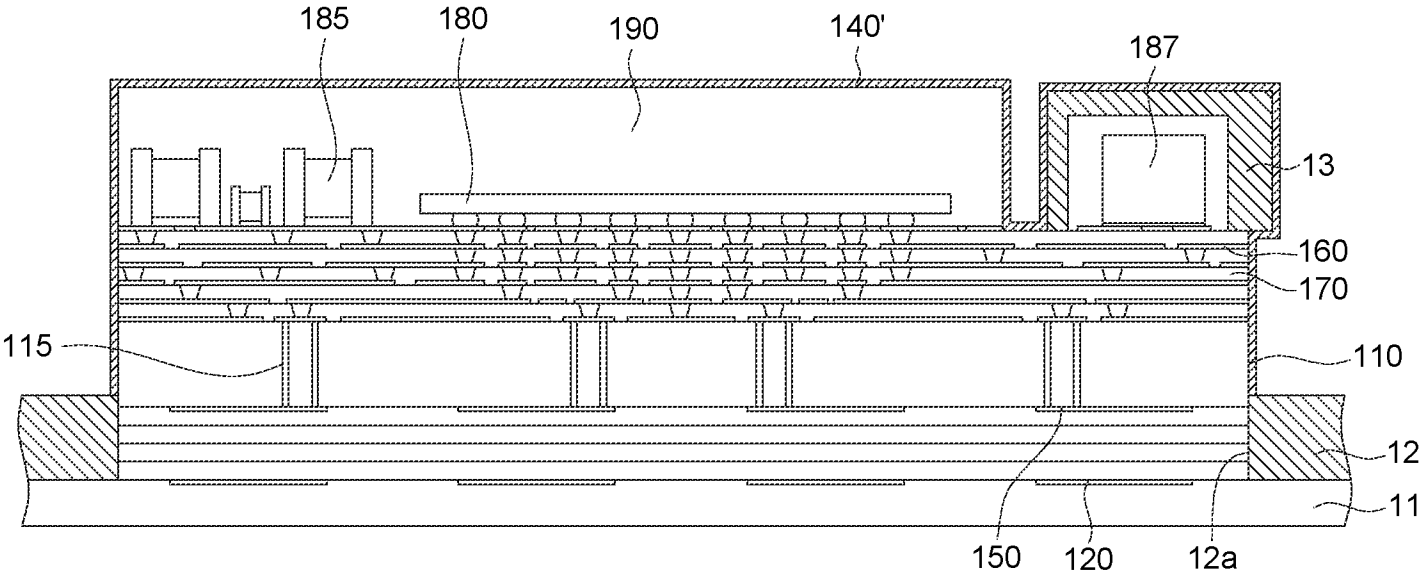

As illustrated in FIG. 17C, a conductive layer 140' is formed, by sputtering or spraying the conductive coating material, to cover portions of the structure 100' which are not covered by the adhesive layer 11, the metal frame 12 and the cover 13. In addition, the conductive layer 140' is made of a metal including, for example, aluminum, copper, gold, silver, iron or a combination thereof.

Figure 17D:
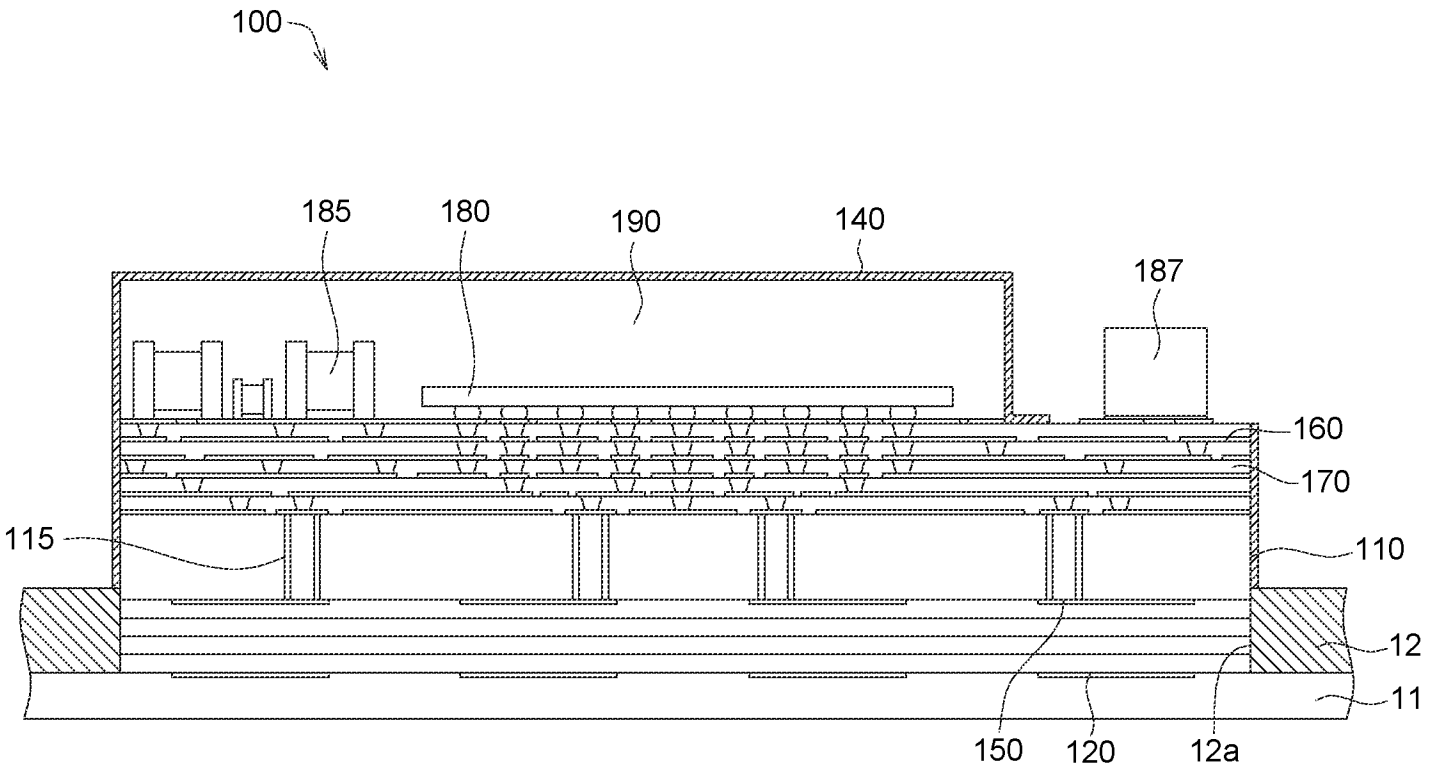

As illustrated in FIG. 17D, the cover 13 is removed to form the conductive layer 140, and the antenna module 100 is formed.

Figure 18:
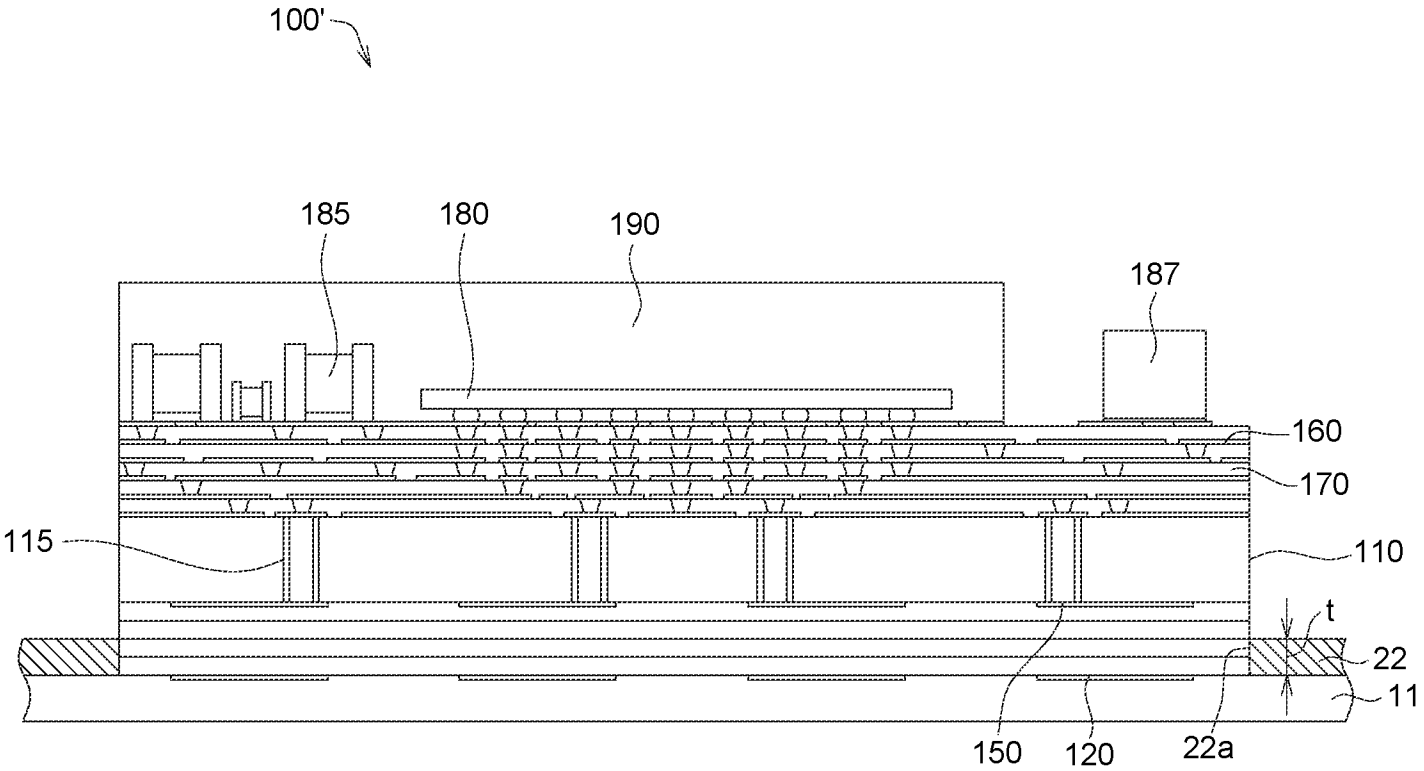
FIG. 18 illustrates manufacturing processes of the antenna module of FIG. 2.

Referring to FIG. 18, FIG. 18 illustrates manufacturing processes of the antenna module 200 of FIG. 2.

As illustrated in FIG. 18, the structure 100' including the first dielectric layer 110, at least one conductive via 115, the first antenna layer 120, the grounding layer 130, the conductive layer 140, the second antenna layer 150, at least one routing layer 160 and at least one dielectric layer 170, at least one first electronic component 180, at least one second electronic component 185, the connector 187 and molding compound 190 is disposed on the adhesive layer 11 and in a metal frame 22. The metal frame 22 has a penetrating portion 22*a* for receiving a portion of the first dielectric layer 110.

In the present embodiment, the penetrating portion 22*a* of the metal frame 22 has depth t different from that of the penetrating portion 12*a* of the metal frame 12, and accordingly it could control the extension length of the conductive layer 140 on the first dielectric layer 110.

Other manufacturing processes of the antenna module 200 are similar to the corresponding manufacturing processes of the antenna module 100, and the similarities are repeated here.

Referring to FIGS. 19A to 19D, FIGS. 19A to 19D illustrate manufacturing processes of the antenna module 300 of FIG. 3.

Figure 19A:
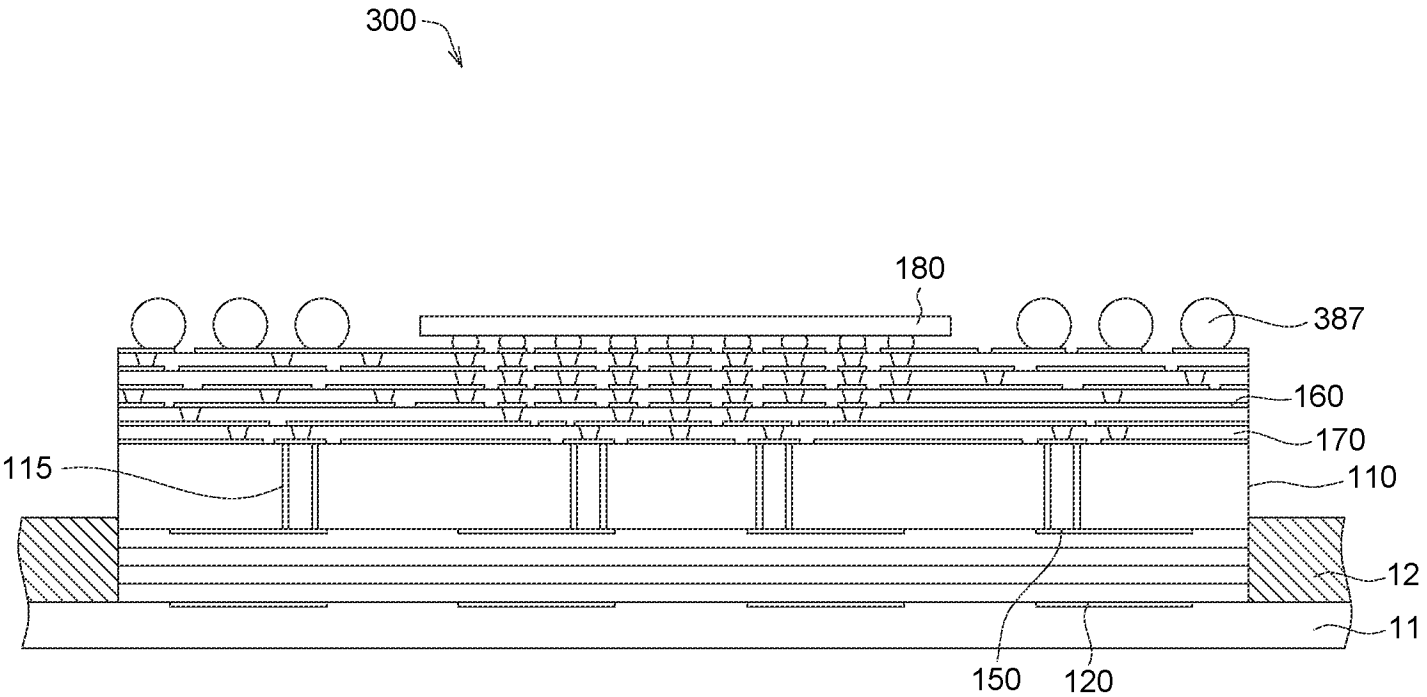
FIGS. 19A to 19D illustrate manufacturing processes of the antenna module of FIG. 3.

As illustrated in FIG. 19A, the structure 300' including the first dielectric layer 110, at least one conductive via 115, the first antenna layer 120, the grounding layer 130, the conductive layer 140, the second antenna layer 150, at least one routing layer 160 and at least one dielectric layer 170, at least one first electronic component 180 and at least one contact 387 is disposed on the adhesive layer 11 and in the metal frame 12. The metal frame 12 has the penetrating portion 12*a* for receiving a portion of the first dielectric layer 110.

Figure 19B:
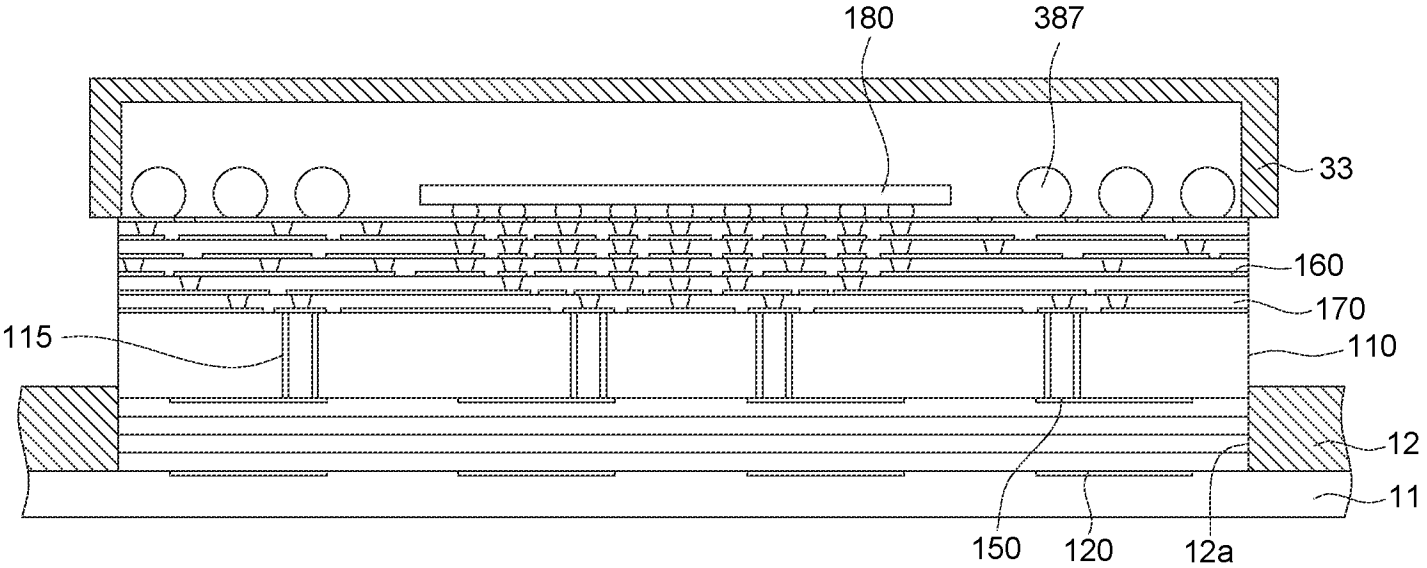

As illustrated in FIG. 19B, a cover 33 is disposed to cover the contacts 387.

Figure 19C:
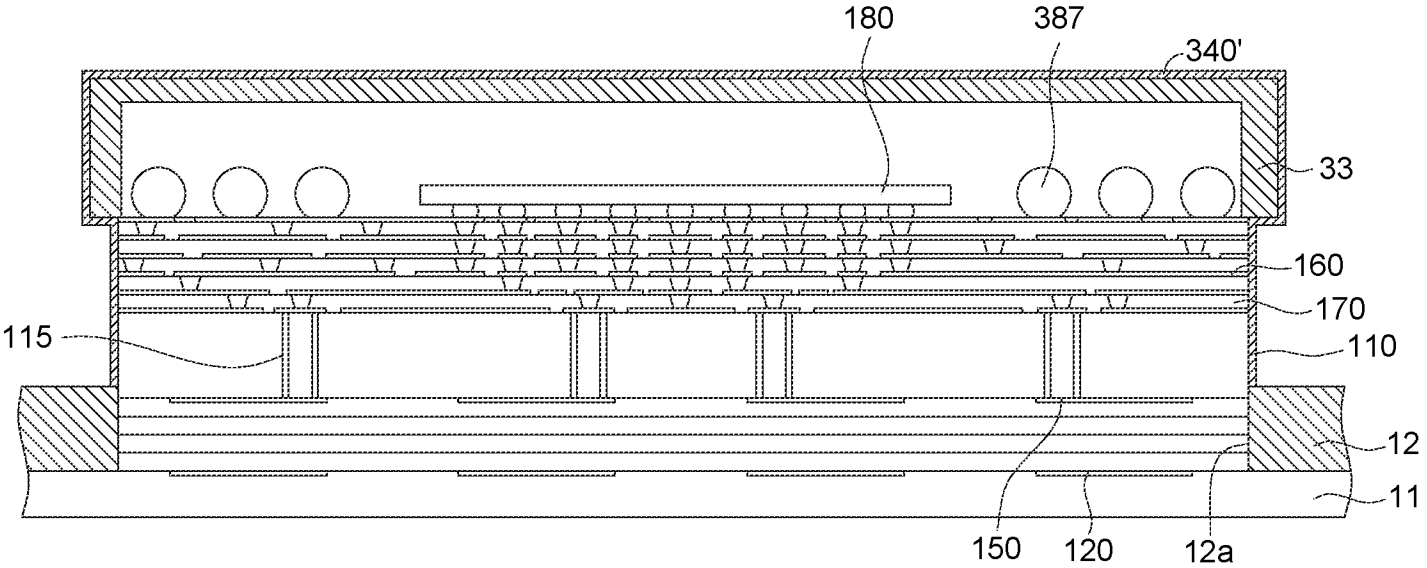

As illustrated in FIG. 19C, a conductive layer 340' is formed to cover portions of the structure 300' which are not covered by the adhesive layer 11, the metal frame 12 and the cover 33.

Figure 19D:
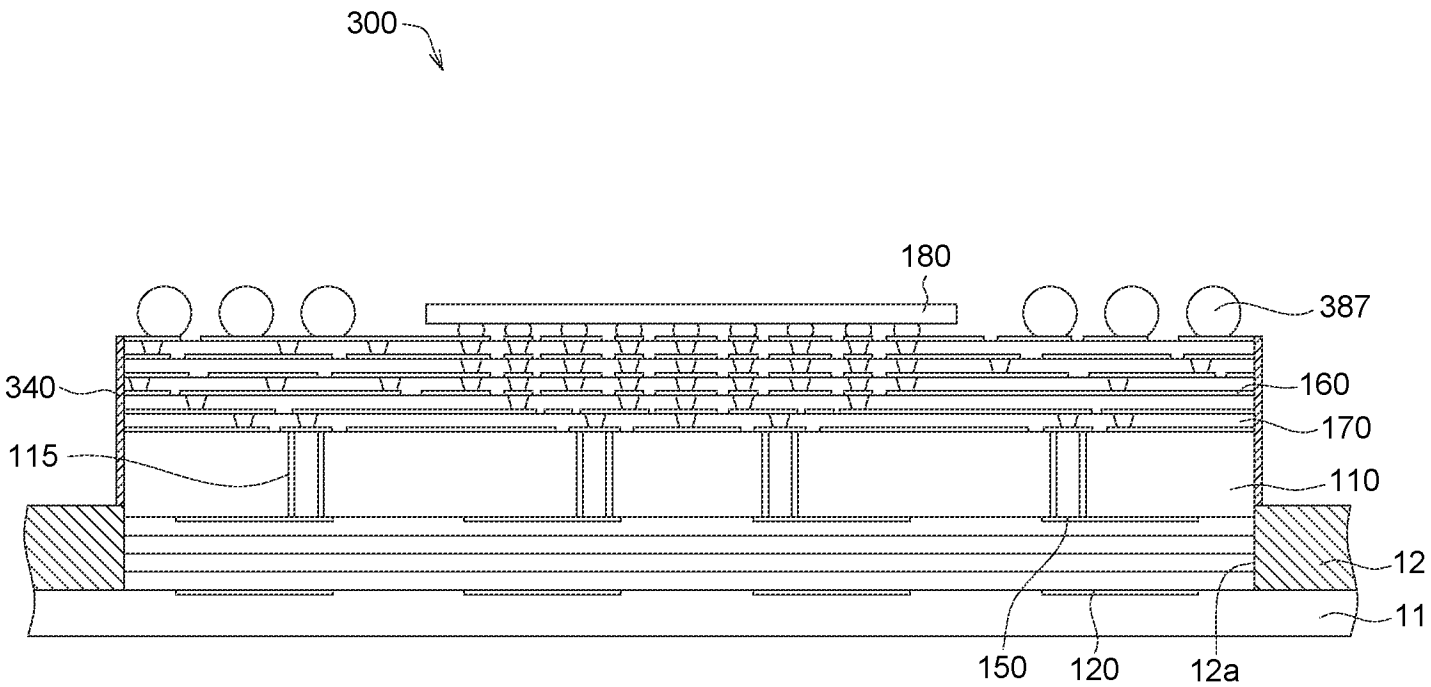

As illustrated in FIG. 19D, the cover 33 is removed to form the conductive layer 340, and the antenna module 300 is formed.

The manufacturing processes of each of the antenna modules 400, the substrate 500A and the substrate 600A are similar to the manufacturing processes of the antenna module 300, and the similarities are repeated here.

Referring to FIGS. 20A to 20G, FIGS. 20A to 20G illustrate manufacturing processes of the antenna module 300' of FIG. 4.

Figure 20A:
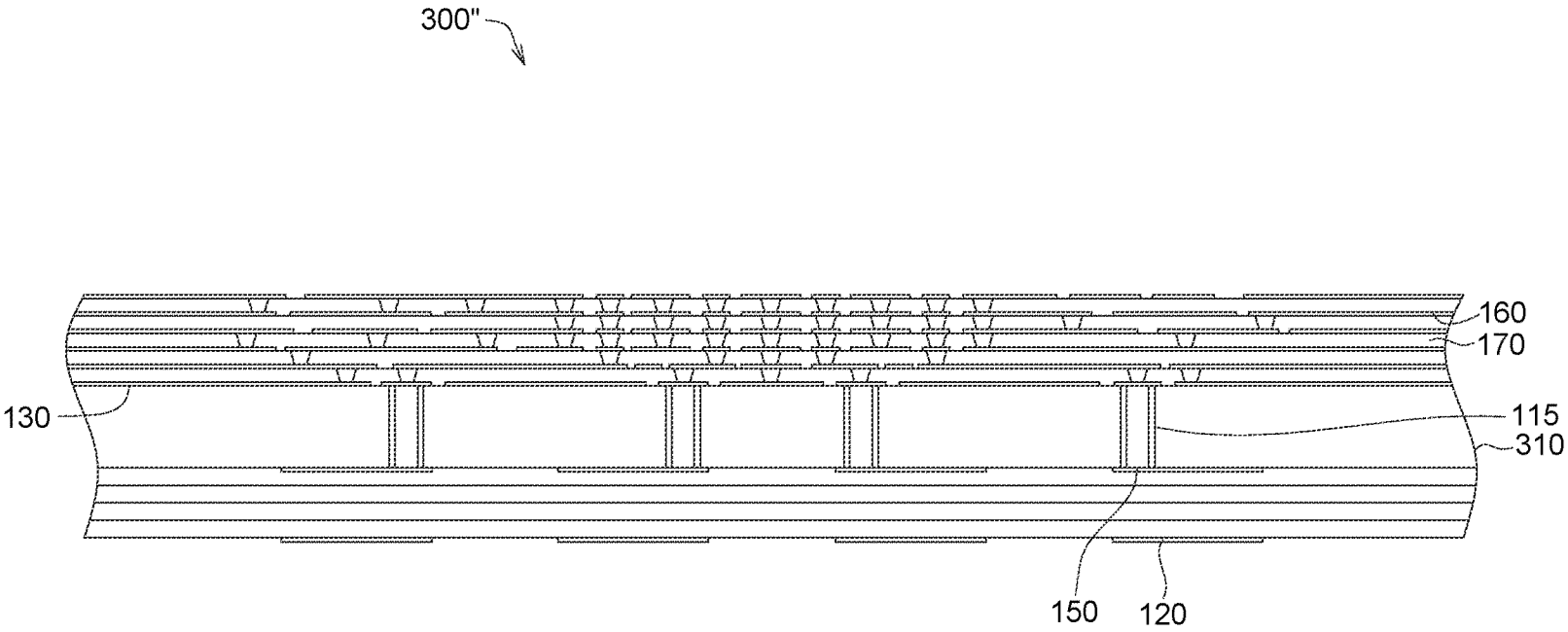
FIGS. 20A to 20G illustrate manufacturing processes of the antenna module of FIG. 4.

As illustrated in FIG. 20A, the structure 300" including the first dielectric layer 310, at least one conductive via 115, the first antenna layer 120, the grounding layer 130, the second antenna layer 150, at least one routing layer 160 and at least one dielectric layer 170 is provided. Although not illustrated, a solder mask (not illustrated) could cover the routing layer 160 and/or the least one dielectric layer 170, and has a plurality of openings exposing a plurality of contacts (for example, solder pads) electrically connected with the routing layer 160.

Figure 20B:
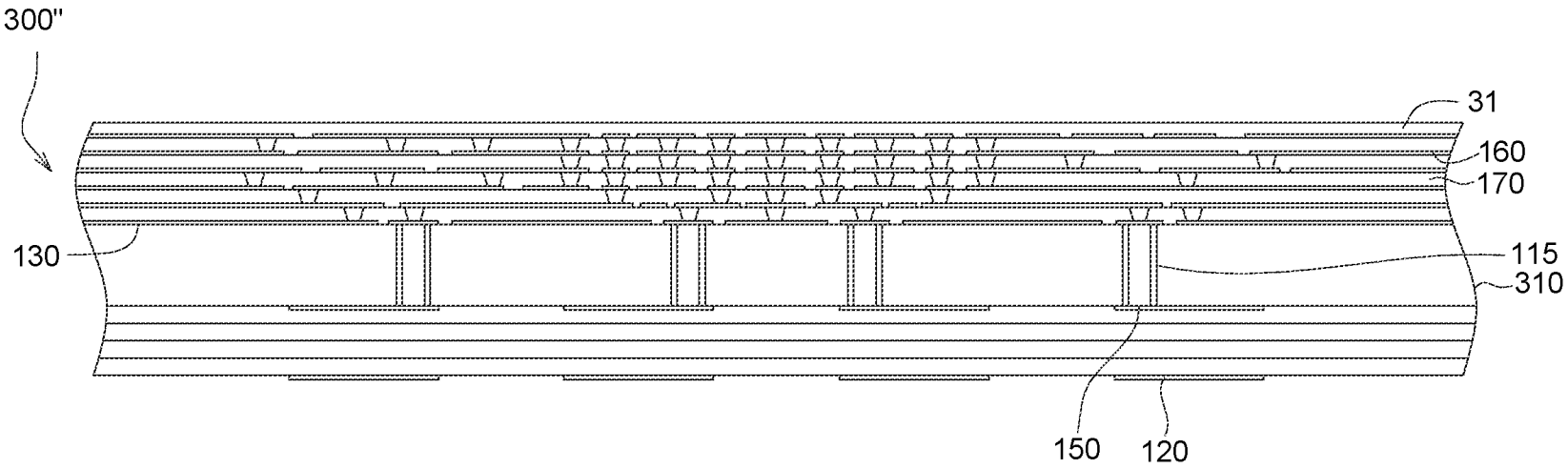

As illustrated in FIG. 20B, an adhesive layer 31 is formed to cover the solder mask (not illustrated) and the contacts (not illustrated) exposed from the solder mask of the structure 300".

Figure 20C:
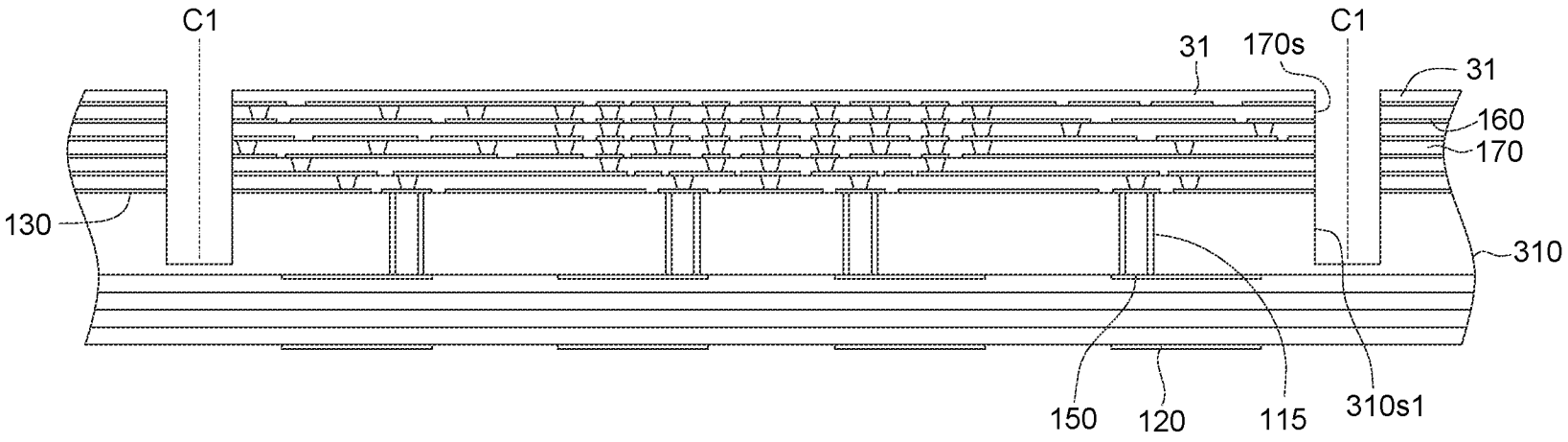

As illustrated in FIG. 20C, at least one of first singulation passage C1 passing through the adhesive layer 31, the routing layer 160, the dielectric layer 170 and a portion of the first dielectric layer 310 is formed. After the first singulation passage C1 is formed, each dielectric layer 170 forms the second dielectric lateral surface 170*s* and the first dielectric layer 310 forms the first lateral surface 310*s*1.

Figure 20D:
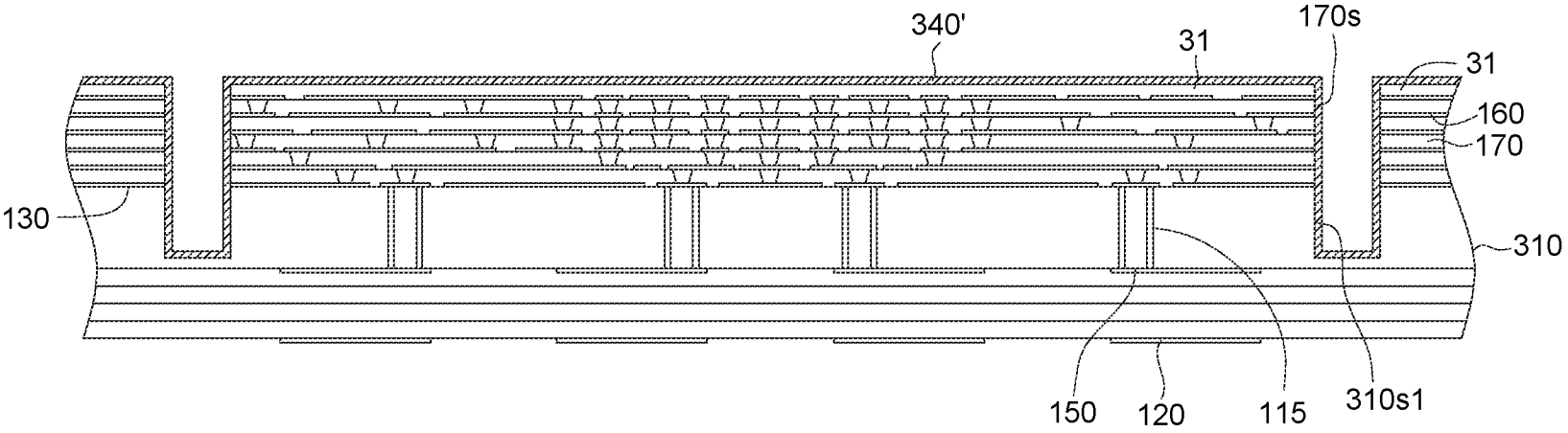

As illustrated in FIG. 20D, the conductive layer 340' covering the adhesive layer 31, the second dielectric lateral surface 170*s* of each second dielectric layer 170 and the first lateral surface 310*s*1 of the first dielectric layer 310 is formed by sputtering or spraying the conductive coating material.

Figure 20E:
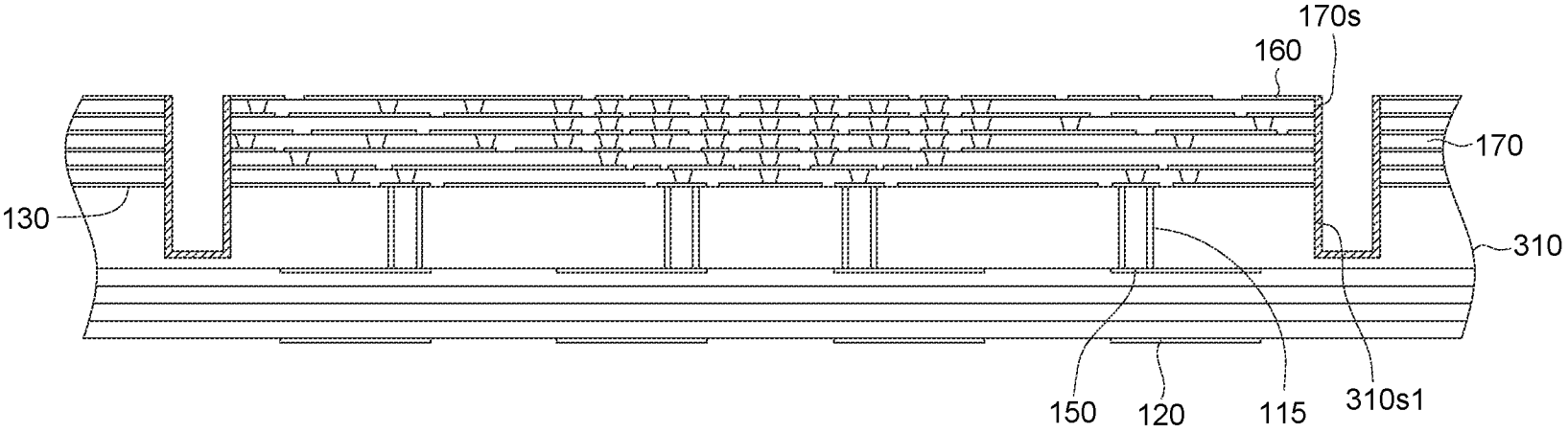

As illustrated in FIG. 20E, the adhesive layer 31 is removed to expose the solder mask (not illustrated) and the contacts (not illustrated) exposed from the solder mask.

Figure 20F:
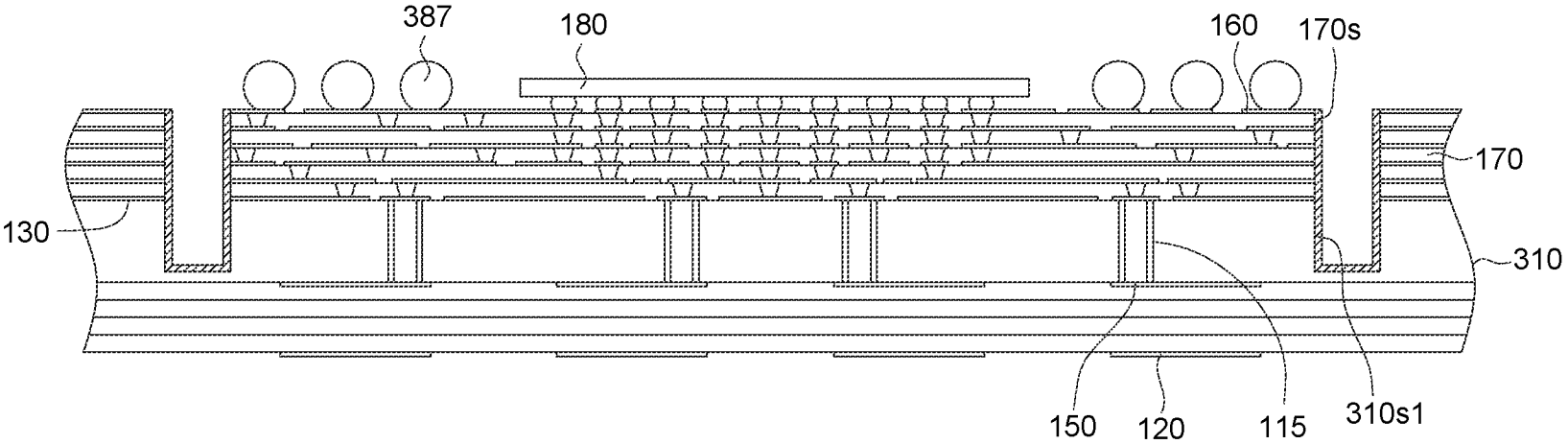

As illustrated in FIG. 20F, at least one first electronic component 180 and/or at least one contact 387 are disposed on the contacts (not illustrated) exposed from the solder mask.

Figure 20G:
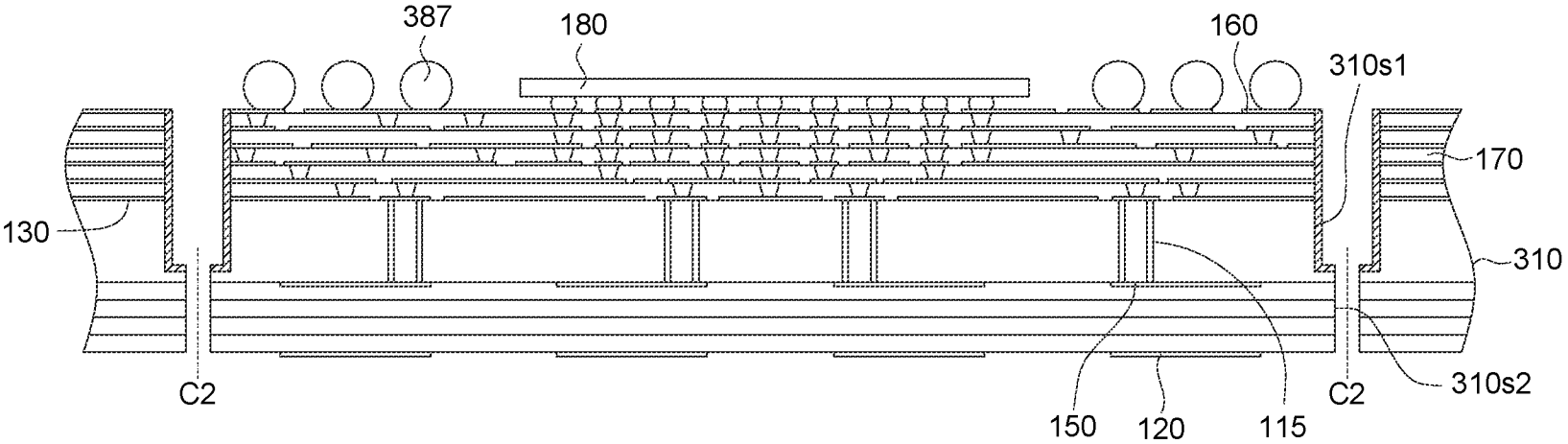

As illustrated in FIG. 20G, at least one of second singulation passage C2 passing through another portion of the first dielectric layer 310 is formed to cut off the first dielectric layer 310. After the second singulation passage C2 is formed, the first dielectric layer 310 forms the second lateral surface 310*s*2, wherein the first lateral surface 310*s*1 and the second lateral surface 310*s*2 are not non-coplanar.

The manufacturing processes of each of the antenna modules 400', the substrate 500A' and the substrate 600A' is similar to the manufacturing processes of the antenna module 300', and the similarities are repeated here.

Referring to FIGS. 21A to 21G, FIGS. 21A to 21G illustrate manufacturing processes of the antenna module 700 of FIG. 11.

Figure 21A:
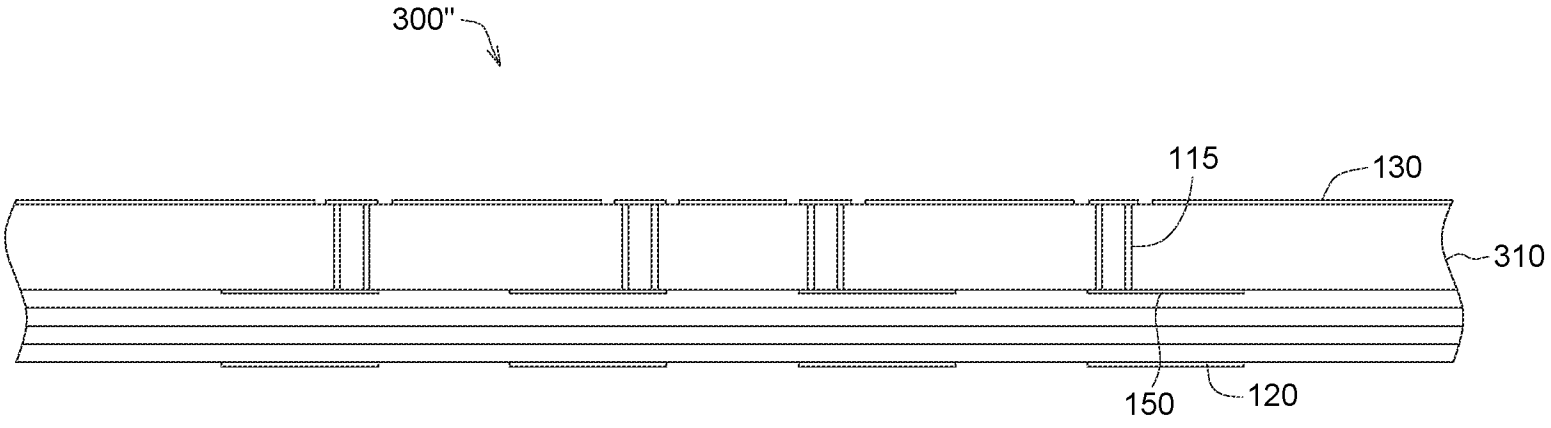
FIGS. 21A to 21G illustrate manufacturing processes of the antenna module of FIG. 11.

As illustrated in FIG. 21A, the structure 700' including the first dielectric layer 310, at least one conductive via 115, the first antenna layer 120, the grounding layer 130, the second antenna layer 150 is provided.

Figure 21B:
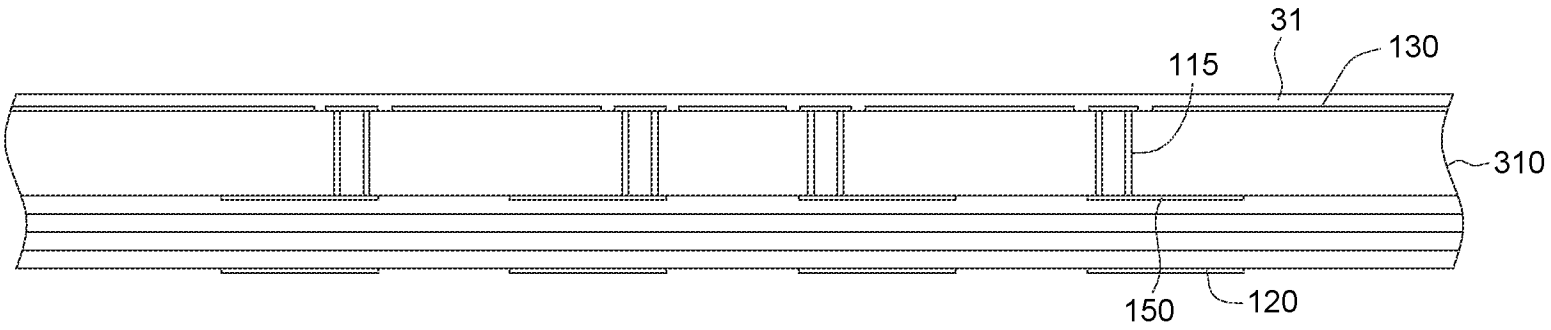

As illustrated in FIG. 21B, an adhesive layer 31 covers the first dielectric layer 310 of the structure 700'.

Figure 21C:
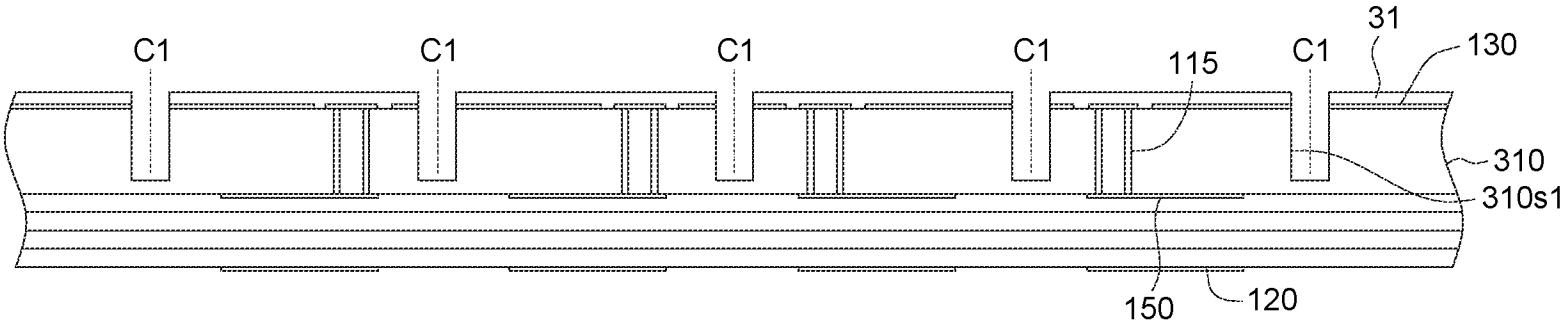

As illustrated in FIG. 21C, a plurality of the first singulation passages C1 passing through the adhesive layer 31 and a portion of the first dielectric layer 310 is formed. After the first singulation passage C1 is formed, the first dielectric layer 310 forms the first lateral surface 310*s*1.

Figure 21D:
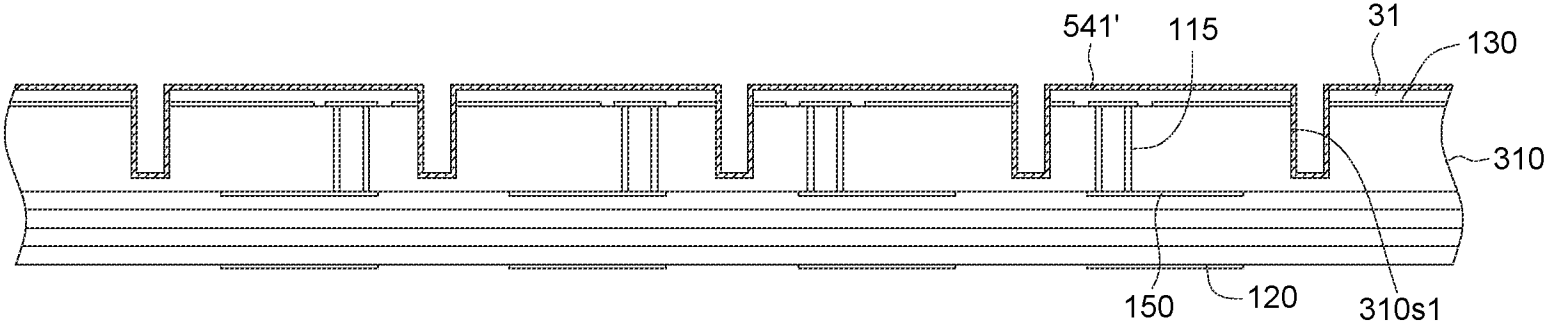

As illustrated in FIG. 21D, the first conductive layer 541' covering the adhesive layer 31 and the first lateral surface 310*s*1 of the first dielectric layer 310 is formed by sputtering or spraying the conductive coating material.

Figure 21E:
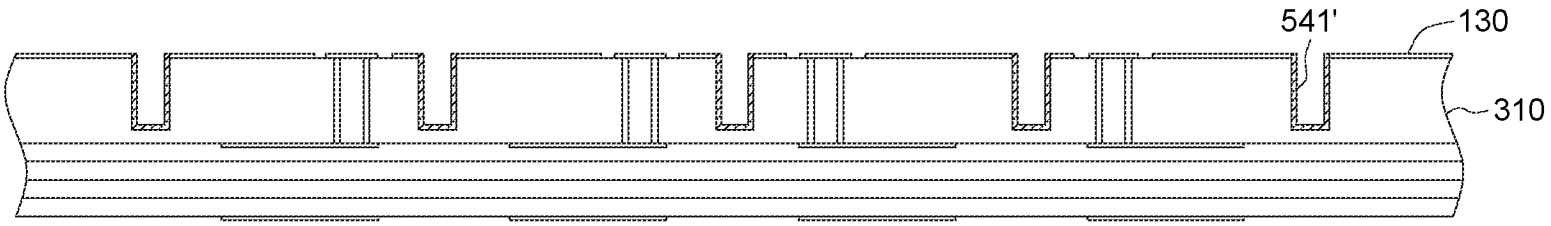

As illustrated in FIG. 21E, the adhesive layer 31 is removed to expose solder mask (not illustrated) and the contacts (not illustrated) exposed from the solder mask.

Figure 21F:
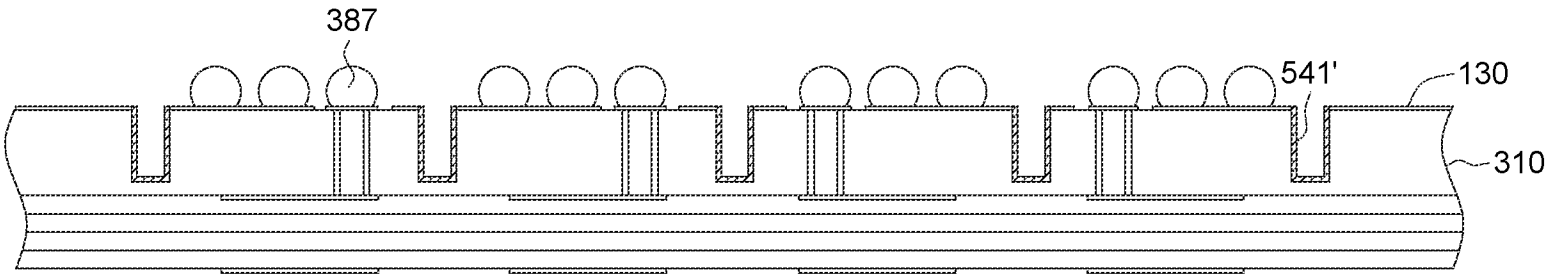

As illustrated in FIG. 21F, at least one contact 387 is disposed on the contacts exposed from the solder mask (not illustrated).

Figure 21G:
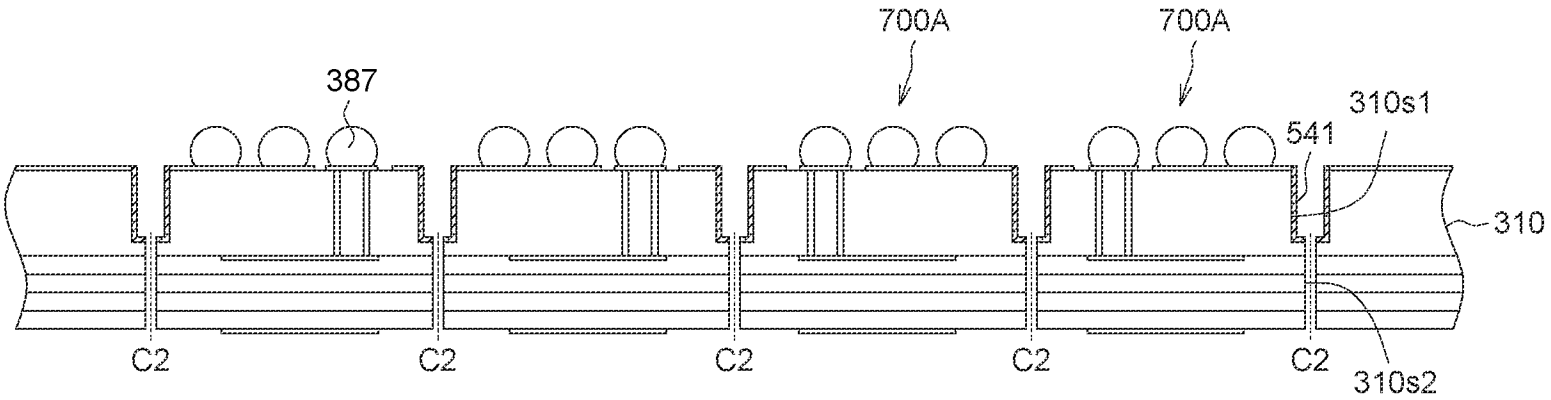

As illustrated in FIG. 21G, at least one of second singulation passage C2 passing through another portion of the first dielectric layer 310 is formed to cut off the first dielectric layer 310, and form a plurality of the antenna units 700A. After the second singulation passage C2 is formed, the first dielectric layer 310 forms the second lateral surface 310*s*2, wherein the first lateral surface 310*s*1 and the second lateral surface 310*s*2 are not non-coplanar.

Then, the antenna units 700A are disposed on the package 500B of FIG. 11 by at least one contact 387 to form the antenna module 700.

The manufacturing processes of the antenna modules 800 are similar to the manufacturing processes of the antenna module 700, and the similarities are repeated here.

Referring to FIGS. 22A to 22G, FIGS. 22A to 22G illustrate manufacturing processes of the antenna module 1000 of FIG. 14.

Figure 22A:
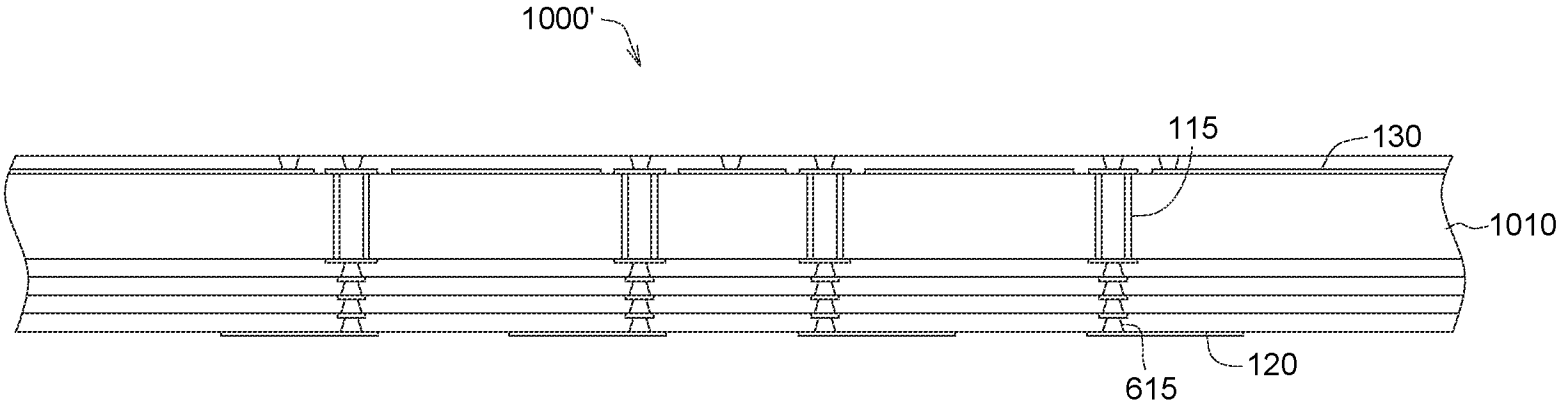
FIGS. 22A to 22G illustrate manufacturing processes of the antenna module of FIG. 14.

As illustrated in FIG. 22A, the structure 1000' including the first dielectric layer 1010, the first antenna layer 120, the grounding layer 130, at least one conductive via 115 and at least one conductive via 615 is provided.

Figure 22B:
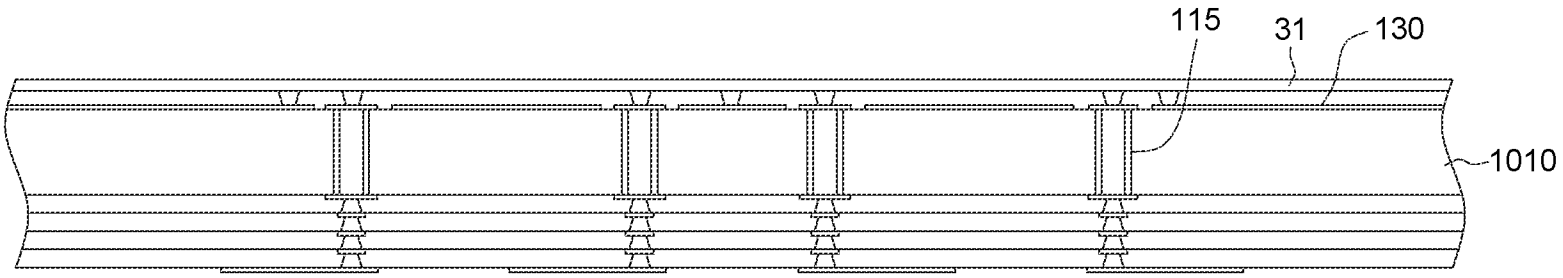

As illustrated in FIG. 22B, the adhesive layer 31 covers the first dielectric layer 1010 of the structure 1000'.

Figure 22C:
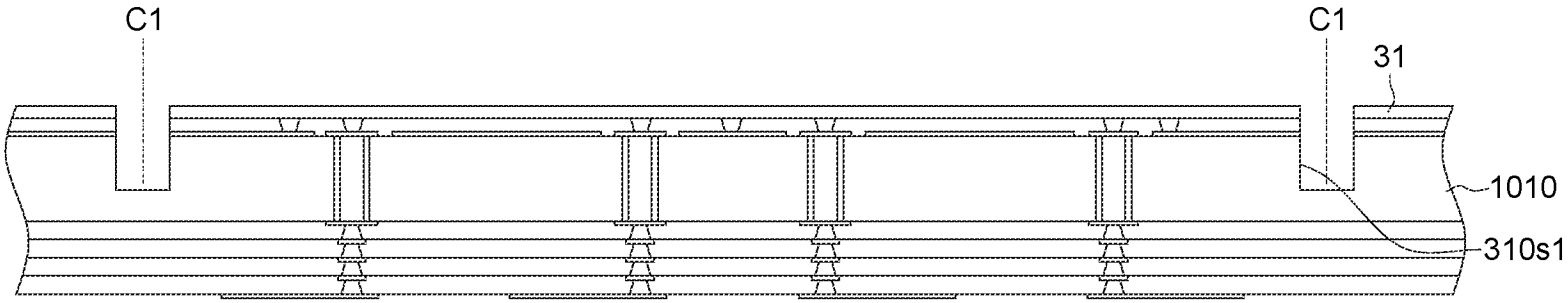

As illustrated in FIG. 22C, a plurality of the first singulation passages C1 passing through the adhesive layer 31 and a portion of the first dielectric layer 1010 is formed. After the first singulation passage C1 is formed, the first dielectric layer 1010 forms the first lateral surface 310*s*1.

Figure 22D:
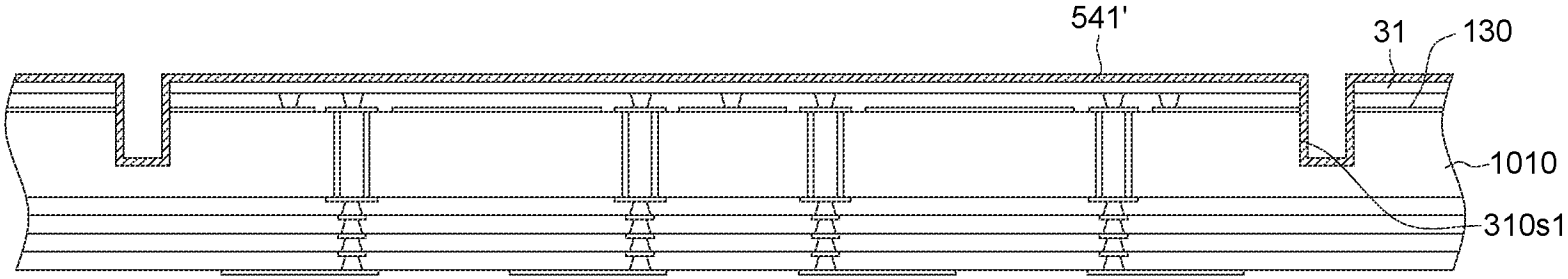

As illustrated in FIG. 22D, the first conductive layer 541' covering the adhesive layer 31 and the first lateral surface 310*s*1 of the first dielectric layer 1010 is formed by sputtering or spraying the conductive coating material.

Figure 22E:
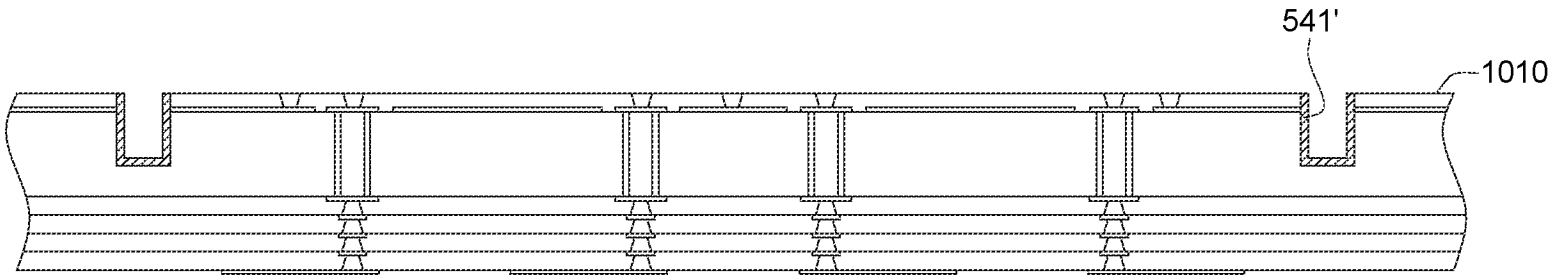

As illustrated in FIG. 22E, the adhesive layer 31 is removed to expose the first dielectric layer 1010 and a plurality of contacts exposed from the first dielectric layer 1010.

Figure 22F:
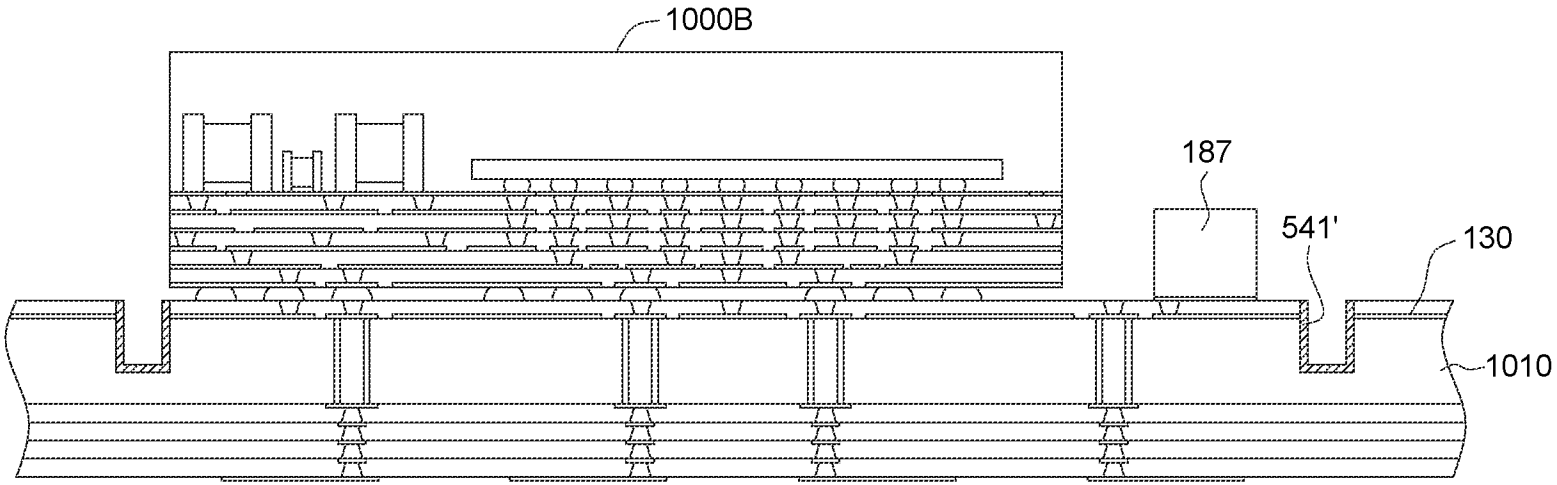

As illustrated in FIG. 22F, the package 1000B of FIG. 14 and the connector 187 are disposed on the contacts exposed from the first dielectric layer 1010 of FIG. 22E.

Figure 22G:
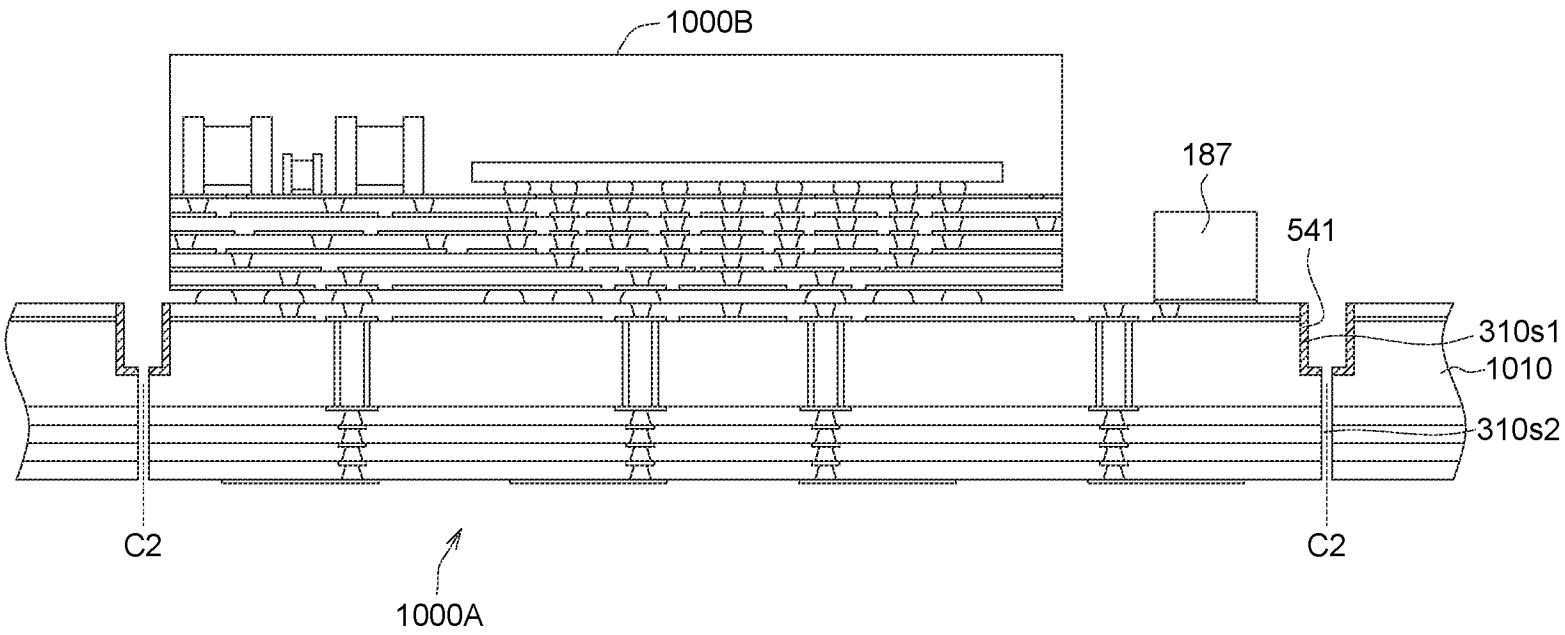

As illustrated in FIG. 22G, at least one of second singulation passage C2 passing through another portion of the first dielectric layer 1010 is formed to cut off the first dielectric layer 1010, and form the antenna module 1000. After the second singulation passage C2 is formed, the first dielectric layer 310 forms the second lateral surface 310*s*2, wherein the first lateral surface 310*s*1 and the second lateral surface 310*s*2 are not non-coplanar.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An antenna module, comprising:

a first dielectric layer having a first dielectric surface and a second dielectric surface opposite to the first dielectric surface and a first dielectric lateral surface extending between the first dielectric surface and the second dielectric surface;

a first antenna layer formed on the first dielectric surface;

a grounding layer formed below the second dielectric surface; and a conductive layer formed on the first dielectric lateral surface of first dielectric layer, wherein the conductive layer electrically connects to the grounding layer and extends from the grounding layer toward the first antenna layer but not contacts the first dielectric surface.

2. The antenna module as claimed in claim 1, further comprises at least one second dielectric layer under the second dielectric surface, and at least one routing layer are formed on a surface of the at least one second dielectric layer.

3. The antenna module as claimed in claim 2, wherein the conductive layer further extends from the grounding layer to the surface of the at least one second dielectric layer.

4. The antenna module as claimed in claim 2, wherein further comprises:

a first electronic component disposed on the routing layer; and a molding compound covering the routing layer;

wherein the conductive layer further covers a second dielectric lateral surface of the second dielectric layer and the molding compound.

5. The antenna module as claimed in claim 4, wherein the routing layer exposes a portion not coved by the molding compound; the antenna module further comprises:

a connector disposed on the portion of the routing layer.

6. The antenna module as claimed in claim 2, further comprises:

at least one of contact formed between the first dielectric layer and the second dielectric layer.

7. The antenna module as claimed in claim 6, wherein further comprises:

a first electronic component disposed on the routing layer; and a molding compound covering the routing layer;

wherein the conductive layer further covers a second dielectric lateral surface of the second dielectric layer and the molding compound.

8. The antenna module as claimed in claim 7, wherein the routing layer exposes a portion not coved by the molding compound; the antenna module further comprises:

a connector disposed on the portion of the routing layer.

9. The antenna module as claimed in claim 6, further comprises:

at least one forth dielectric layer between the first dielectric layer and the at least one of contact, and the at least one routing layer is formed on a surface of the at least one forth dielectric layer.

10. The antenna module as claimed in claim 1, wherein the first dielectric layer comprises a plurality of sub-dielectric layers, and at least two of the sub-dielectric layers are made by same or different materials.

11. The antenna module as claimed in claim 10, further comprise a second antenna layer formed on one of the sub-dielectric layers.

12. The antenna module as claimed in claim 11, wherein the conductive layer further extends between the first dielectric surface and the second antenna layer.

13. The antenna module as claimed in claim 1, further comprises:

a routing layer formed under the second dielectric surface; and a contact disposed on the routing layer.

14. The antenna module as claimed in claim 13, further comprises:

a first electronic component disposed to the routing layer;

wherein the first electronic component and the contact are disposed on the same side of the routing layer.

15. The antenna module as claimed in claim 13, further comprises:

a first electronic component disposed to the routing layer;

wherein the first electronic component and the contact are disposed on opposite two sides of the routing layer; the antenna module further comprises:

a third dielectric layer disposed between the routing layer and the first dielectric layer and encapsulating the first electronic component.

16. The antenna module as claimed in claim 1, further comprises:

a plurality of antenna units each comprising the first dielectric layer, the first antenna layer and the grounding layer;

wherein the antenna units are spaced from each other.

17. The antenna module as claimed in claim 1, further comprises:

a first electronic component; and a third dielectric layer within which the first electronic component is formed.

18. The antenna module as claimed in claim 1, further comprises:

a substrate comprising the first dielectric layer, the first antenna layer, the grounding layer and the conductive layer;

a package comprising at least one second dielectric layer under the second dielectric surface and at least one routing layer formed on a surface of the at least one second dielectric layer; and a connector, wherein the package and the connector are disposed on the same side of the substrate.

19. The antenna module as claimed in claim 18, further comprises:

at least one forth dielectric layer between the first dielectric layer and the package, and the at least one routing layer is formed on a surface of the at least one forth dielectric layer.

20. A manufacturing method of an antenna module, comprising:

providing a structure comprising a first dielectric layer, a first antenna layer and a grounding layer, wherein the first dielectric layer has a first dielectric surface and a second dielectric surface opposite to the first dielectric surface and a first dielectric lateral surface extending between the first dielectric surface and the second dielectric surface, the first antenna layer is formed on the first dielectric surface, and the rounding layer is formed below the second dielectric surface;

disposing the structure on an adhesive layer and in a penetrating portion of a metal frame; and forming a conductive layer to cover portions of the structure which are not covered by the adhesive layer and the metal frame, wherein the conductive layer is formed on the first dielectric lateral surface of first dielectric layer, wherein the conductive layer electrically connects to the grounding layer and extends from the grounding layer toward the first antenna layer but not contacts the first dielectric surface.

21. A manufacturing method of an antenna module, comprising:

providing a structure comprising a first dielectric layer, a first antenna layer and a grounding layer, wherein the first dielectric layer has a first dielectric surface and a second dielectric surface opposite to the first dielectric surface and a first dielectric lateral surface extending between the first dielectric surface and the second dielectric surface, the first antenna layer is formed on the first dielectric surface, and the rounding layer is formed below the second dielectric surface;

disposing an adhesive layer to cover the first dielectric layer of the structure;

forming a plurality of first singulation passages to pass through the adhesive layer and a portion of the first dielectric layer, wherein the first dielectric layer forms a first lateral surface;

forming a conductive layer to cover the adhesive layer and the first lateral surface;

removing the adhesive layer to expose the first dielectric layer; and forming a plurality of second singulation passages to pass through another portion of the first dielectric layer, wherein the first dielectric layer forms a second lateral surface, and the first lateral surface and the second lateral surface are not non-coplanar.

* * * * *